US010295248B2

(12) United States Patent
Miller et al.

(10) Patent No.: US 10,295,248 B2
(45) Date of Patent: May 21, 2019

(54) REFRIGERATOR WITH GLASS DOOR

(71) Applicant: Electrolux Home Products, Inc., Charlotte, NC (US)

(72) Inventors: Orin Miller, Clemson, SC (US); Ricky Burgan, Anderson, SC (US); Doug Burnett, Anderson, SC (US); Miranda Valentino, Charlotte, NC (US); Joel Riddell, Charlotte, NC (US); Varun Rajasekaran, Charlotte, NC (US); Jose Macias, Anderson, SC (US); Terry Lynn Sexton, Anderson, SC (US); Josh Hanson, Charlotte, NC (US); Ran Zhou, Charlotte, NC (US); Cornel Comsa, Anderson, SC (US); Matthew Elexy Edge, Anderson, SC (US); Billy Seth Lon Campbell, Pendleton, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 33 days.

(21) Appl. No.: 15/401,908

(22) Filed: Jan. 9, 2017

(65) Prior Publication Data

US 2018/0192791 A1 Jul. 12, 2018

(51) Int. Cl.

*A47B 96/04* (2006.01)
*F25D 27/00* (2006.01)

(Continued)

(52) U.S. Cl.

CPC ..... *F25D 27/005* (2013.01); *A47F 3/043* (2013.01); *F25D 23/02* (2013.01); *F25D 23/04* (2013.01); *F25D 2700/06* (2013.01)

(58) Field of Classification Search

CPC ... A47F 3/0434; F25D 27/005; F25D 2700/06

(Continued)

(56) References Cited

U.S. PATENT DOCUMENTS 3,411,247 A 11/1968 Fleming
3,778,175 A * 12/1973 Zimmer ..... B62D 33/044 403/187

(Continued)

FOREIGN PATENT DOCUMENTS

DE 3143517 5/1983
KR 1020070056549 12/2008

(Continued)

*Primary Examiner* — Matthew W Ing

(74) *Attorney, Agent, or Firm* — Pearne & Gordon LLP

(57) ABSTRACT

A refrigeration appliance includes a cabinet that defines a storage compartment. A door is pivotably coupled to the cabinet and is movable between a closed position for closing the storage compartment and an open position for allowing access to the storage compartment. The door includes an inner surface and an outer surface. An opening extends between the inner surface and the outer surface. A window is disposed within the opening. The window optionally includes a lower portion that is non-transparent. A storage bin is attachable to a lower portion of the inner surface of the door wherein the non-transparent portion of the window obstructs viewing of the storage bin when the door is in the closed position.

24 Claims, 22 Drawing Sheets

(51) Int. Cl.
*F25D 23/04* (2006.01)
*F25D 23/02* (2006.01)
*A47F 3/04* (2006.01)

(58) Field of Classification Search
USPC ..... 312/405.1
See application file for complete search history.

(56) References Cited

U.S. PATENT DOCUMENTS 3,949,526 A 4/1976 Sherlock et al.
4,496,201 A 1/1985 Allgeyer
4,741,127 A 5/1988 Bockwinkel
4,831,780 A 5/1989 Bockwinkel
4,852,303 A 8/1989 Rolek
4,891,912 A 1/1990 Bockwinkel
4,941,289 A 7/1990 Rolek
4,974,366 A 12/1990 Tizzoni
4,998,382 A 3/1991 Kostos et al.
5,024,023 A 6/1991 Kostos et al.
5,097,642 A 3/1992 Richardson et al.
5,111,618 A 5/1992 Kaspar et al.
5,113,628 A 5/1992 Richardson et al.
5,225,473 A 7/1993 Duan
5,363,611 A 11/1994 Richardson et al.
RE35,149 E 1/1996 Richardson et al.
5,544,454 A 8/1996 Richardson et al.
RE35,392 E 12/1996 Richardson et al.
5,887,398 A 3/1999 Chen
5,910,083 A 6/1999 Richardson et al.
6,122,869 A 9/2000 Richardson
6,209,265 B1 4/2001 Banicevic et al.
D453,169 S 1/2002 Ma et al.
6,619,005 B1 9/2003 Chen
6,722,083 B2 4/2004 Herrmann et al.
6,722,142 B1 4/2004 Pagel
6,773,082 B2 8/2004 Lee
6,952,899 B2 10/2005 Herrmann et al.
6,964,131 B2 11/2005 Herrmann et al.
7,043,886 B1 5/2006 Chubb
7,634,880 B2 12/2009 Sironko et al.
8,136,327 B1 3/2012 Sokol et al.
D671,574 S 11/2012 Jafa et al.
8,312,694 B2 11/2012 Hecht et al.
8,336,974 B2 12/2012 Lee et al.
8,382,220 B2 2/2013 Kim
8,439,461 B2 5/2013 Kim
8,523,375 B2 9/2013 Kim et al.
8,668,292 B2 3/2014 Pae
8,683,745 B2 4/2014 Artwohl et al.
8,752,921 B2 6/2014 Gorz et al.
8,770,682 B2 7/2014 Lee et al.
8,776,443 B2 7/2014 Bienick
8,789,998 B2 7/2014 Schneider et al.
8,869,493 B2 10/2014 Chubb et al.
D718,352 S 11/2014 Lee et al.
8,881,542 B2 11/2014 Hixson et al.
8,974,105 B2 3/2015 Schneider et al.
9,016,031 B2 4/2015 Chubb et al.
9,046,294 B2 6/2015 Lee et al.
9,052,536 B2 6/2015 Artwohl et al.
9,074,405 B2 7/2015 Shim et al.
9,127,504 B2 9/2015 Sprague
9,155,405 B2 10/2015 Artwohl et al.
9,188,382 B2 11/2015 Kim et al.
9,212,846 B2 12/2015 Lee et al.
D747,367 S 1/2016 Stolarz et al.
9,271,583 B2 3/2016 Guerer
9,297,538 B2 3/2016 Hargrave et al.
9,308,677 B2 4/2016 Lee et al.
9,339,993 B2 5/2016 Cites et al.
D760,819 S 7/2016 Lee et al.
D760,821 S 7/2016 Lee
D760,823 S 7/2016 Lee et al.
D760,824 S 7/2016 Lee
D761,333 S 7/2016 Lee et al.
D761,334 S 7/2016 Lee et al.
D761,336 S 7/2016 Lee et al.
D762,741 S 8/2016 Galiatsis
D762,745 S 8/2016 Galiatsis
2003/0163961 A1 9/2003 Richardson
2005/0194874 A1 9/2005 Jang
2008/0190046 A1* 8/2008 Hecht ..... A47F 3/0434 52/173.1
2012/0286638 A1* 11/2012 Lee ..... F25D 23/02 312/405
2014/0132146 A1* 5/2014 Kim ..... F25D 23/025 312/405.1
2014/0230337 A1 8/2014 Shim et al.
2014/0313105 A1 10/2014 Peso et al.
2015/0096257 A1 4/2015 Sinnathamby et al.
2015/0170608 A1 6/2015 Kim et al.
2015/0228253 A1 8/2015 Lee et al.
2015/0245720 A1 9/2015 Isfort et al.
2015/0260444 A1 9/2015 Lee et al.
2015/0335174 A1* 11/2015 Artwohl ..... A47F 3/0434 349/12
2015/0338715 A1 11/2015 Schaefer et al.
2016/0040923 A1 2/2016 Kim et al.
2016/0047589 A1 2/2016 Lee et al.
2016/0051064 A1 2/2016 Lee et al.
2016/0061514 A1 3/2016 Seo et al.
2016/0095450 A1 4/2016 Trulaske, Sr.
2016/0161128 A1 6/2016 Hargrave et al.

FOREIGN PATENT DOCUMENTS

KR 1020100126093 12/2010
WO WO-2016017882 A1 * 2/2016 ..... G06F 9/00

* cited by examiner

REFRIGERATOR WITH GLASS DOOR

FIELD OF THE INVENTION

This application relates generally to a refrigeration appliance, and more particularly, to a refrigeration appliance that includes a glass window in a door of the appliance for allowing viewing of the contents of the refrigeration appliance without opening the door.

BACKGROUND OF THE INVENTION

Conventional refrigeration appliances, such as domestic refrigerators, have a solid, insulated door that closes the compartment(s) of the appliance. The door is heavily insulated to help maintain the temperature within the compartment(s) within an acceptable temperature range. When the compartment is a fresh food compartment a refrigeration system maintains the compartment at temperatures above 0° C. for food items such as fruits, vegetables, and beverages. When the compartment is a freezer compartment, the refrigeration system maintains the compartment at temperatures below 0° C. However, these conventional refrigerator doors are opaque.

Grocery stores typically utilize refrigeration appliances where a door of the appliance is made of glass. The glass allows the grocery store the ability to present products for sale in an aesthetically pleasing manner and allows consumers to view the products prior to opening the door to retrieve the desired product. One particular problem with these conventional refrigeration appliances is that the doors are usually poorly insulated. This is not a great concern in grocery stores as the loss of cool air is compensated for by using large refrigeration systems and the economic sale of the purchased items.

However, it is impractical and costly to use large refrigeration systems for refrigeration appliances that are intended for household use. Accordingly, there is a need in the art of refrigeration systems to provide a refrigeration appliance with a glass door that is energy efficient and still allows a user the ability to view the contents of the appliance without opening the door.

BRIEF SUMMARY OF THE INVENTION

There is provided a refrigeration appliance that includes a cabinet defining a storage compartment. A door is pivotably coupled to the cabinet and is movable between a closed position for closing the storage compartment and an open position for allowing access to the storage compartment. The door includes an inner surface, an outer surface and an opening extending between the inner surface and the outer surface. A window covers the opening. The window includes a lower portion that is non-transparent. A storage bin is on a lower portion of the door, wherein the lower portion of the window obstructs viewing of the storage bin through the window when the door is in the closed position There is also provided door for a refrigeration appliance. The door is pivotably coupled to a cabinet of the refrigeration appliance and is movable between a closed position for closing a storage compartment of the cabinet and an open position for allowing access to the storage compartment. The door includes an inner surface, an outer surface and an opening extending between the inner surface and the outer surface. A window covers the opening. A frame assembly is disposed between the inner surface and the outer surface. The frame assembly includes a pair of vertical frame members each dimensioned to receive a preformed insulating element. A lower support assembly is attached to lower portion of each of the pair of vertical frame members. The lower support assembly includes a first horizontal frame member having distal ends attachable to each of the pair of vertical frame members wherein the first horizontal frame member is dimensioned to receive a preformed insulating element. An upper frame member has distal ends attachable to an upper end of the pair of vertical frame members. The upper frame member is dimensioned to receive a preformed insulating element.

There is also provided a door for a refrigeration appliance. The door is pivotably coupled to a cabinet of the refrigeration appliance and is movable between a closed position for closing a storage compartment of the cabinet and an open position for allowing access to the storage compartment. The door includes an inner surface, an outer surface and an opening extending between the inner surface and the outer surface. A window covers the opening. A frame assembly is disposed between the inner surface and the outer surface. The frame assembly includes a pair of vertical frame members each dimensioned to receive a preformed insulating element. A lower support assembly is attached to lower portion of each of the pair of vertical frame members. The lower support assembly includes a first horizontal frame member having distal ends attachable to each of the pair of vertical frame members. The first horizontal frame member is dimensioned to receive a preformed insulating element. An upper frame member has distal ends attachable to an upper end of the pair of vertical frame members. The upper frame member is dimensioned to receive a preformed insulating element.

BRIEF DESCRIPTION OF THE DRAWINGS

FIG. 2 is a front view of the refrigeration appliance of FIG. 1 showing an interior light of the fresh food compartment turned on;

DESCRIPTION OF EXAMPLE EMBODIMENTS

Figure 1:
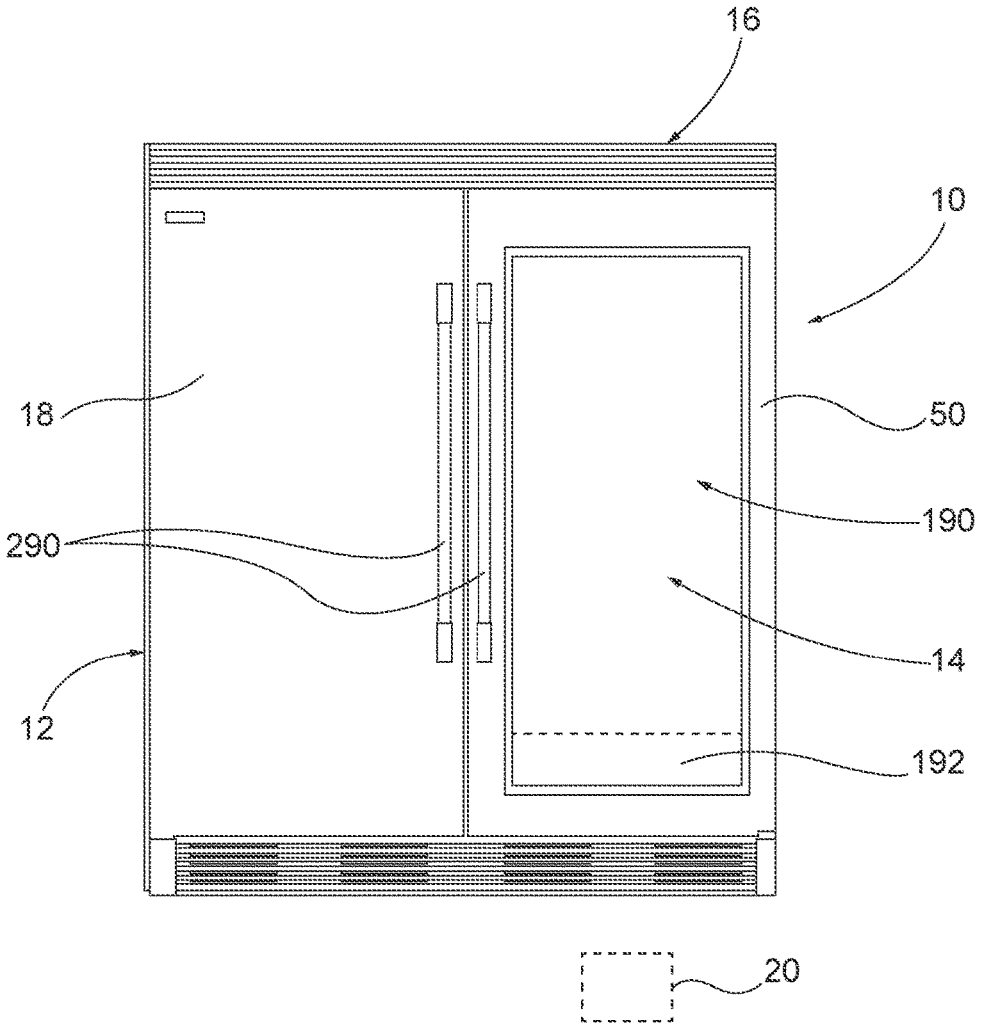
FIG. 1 is a front view of a household refrigeration appliance showing a freezer compartment on the left side and a fresh food compartment on the right side.

Referring now to the drawings, FIG. 1 shows a refrigeration appliance in the form of a twin refrigerator, indicated generally at 10. Although the detailed description that follows concerns an upright twin refrigerator 10 having a freezer compartment 12 and a fresh food compartment 14 in a side-by-side configuration, the invention can be embodied by other refrigeration appliances, e.g., a single door refrigerator or freezer, a top-mount refrigerator (i.e., the freezer is located vertically-above the fresh food compartment), a bottom-mount refrigerator (i.e., the freezer is located vertically-below the fresh food compartment), a French-door bottom-mount refrigerator (i.e., a bottom-mount refrigerator that includes adjacent "French" style doors), etc.

The freezer compartment 12 of the refrigerator 10 is used to freeze and/or maintain articles of food in a frozen condition. For this purpose, the freezer compartment 12 is in thermal communication with a freezer evaporator (not shown) that removes thermal energy from the freezer compartment 12 to maintain a temperature of 0° C. or less during operation of the refrigerator 10.

The fresh food compartment 14 serves to minimize spoiling of articles of food stored therein. The fresh food compartment 14 accomplishes this by maintaining the temperature in the fresh food compartment 14 at a cool temperature that is typically less than an ambient temperature of the refrigerator 10, but somewhat above 0° C., so as not to freeze the articles of food in the fresh food compartment 14. According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C. As can be appreciated, the refrigerator can further include an ice maker located within either or both of the freezer compartment 12 and fresh food compartment 14, including within the interior compartments thereof or mounted upon the doors thereof. Similarly, either or both of the doors can include other features, such as ice or water dispensers, a user interface, etc.

In the embodiment shown, a door 50 is pivotally coupled to a cabinet 16 of the refrigerator 10 to restrict and grant access to the fresh food compartment 14. A window 190 is positioned within the door 50 for selectively allowing a user to view the contents of the fresh food compartment 14, as described in detail below. In the embodiment shown, a door 18 of the freezer compartment 12 does not include a window. However, it is contemplated that door 18 could also include a window 190 for allowing selective viewing of the contents of the freezer compartment 12.

Figure 5:
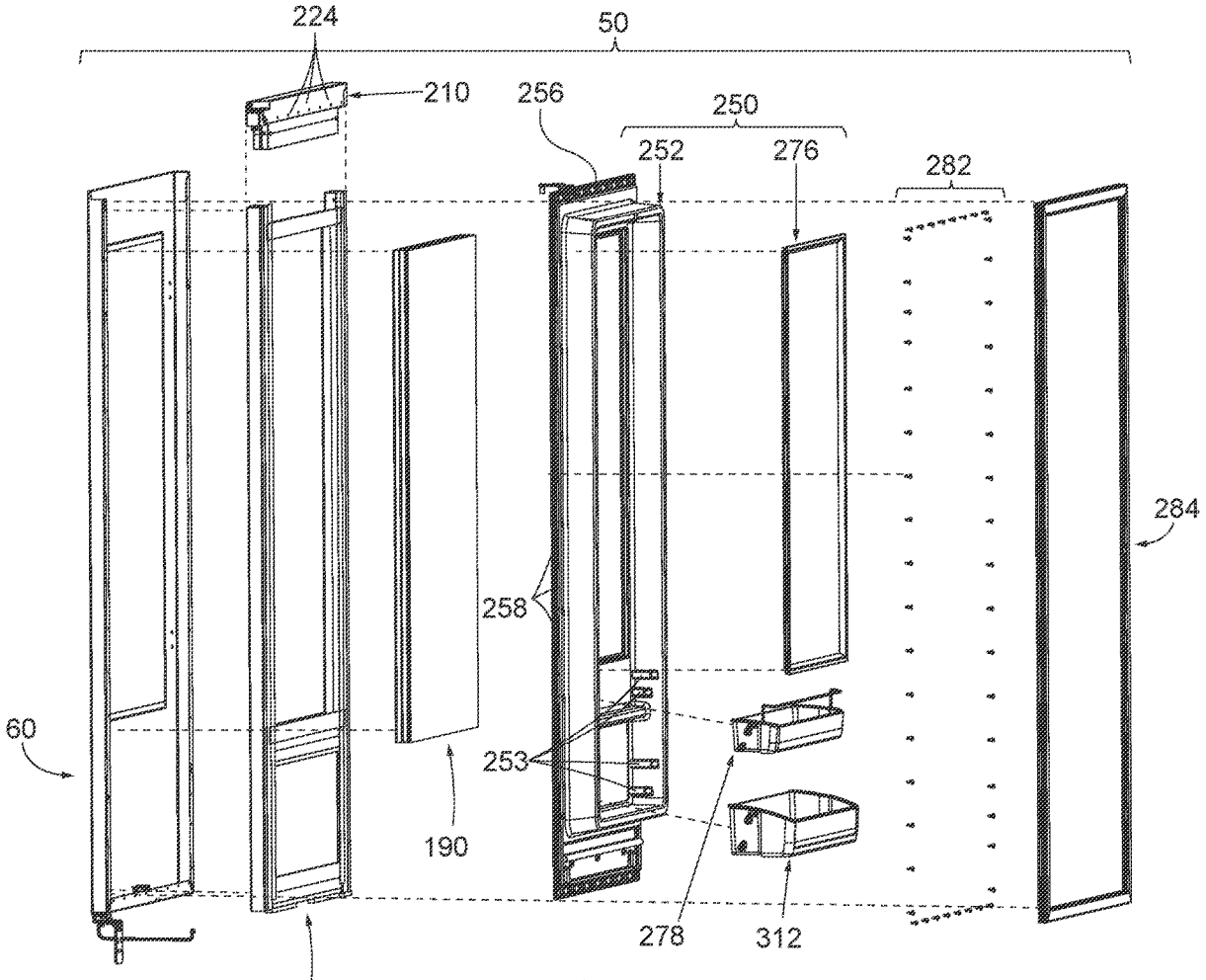
FIG. 5 is an exploded view of the various sub-assemblies of the door shown in FIG. 3.

Referring to FIG. 5, the door 50 includes an outer panel assembly 60, a frame assembly 140, the window 190, an upper frame assembly 210 and a liner assembly 250.

Outer Panel Assembly 60

Figure 6:
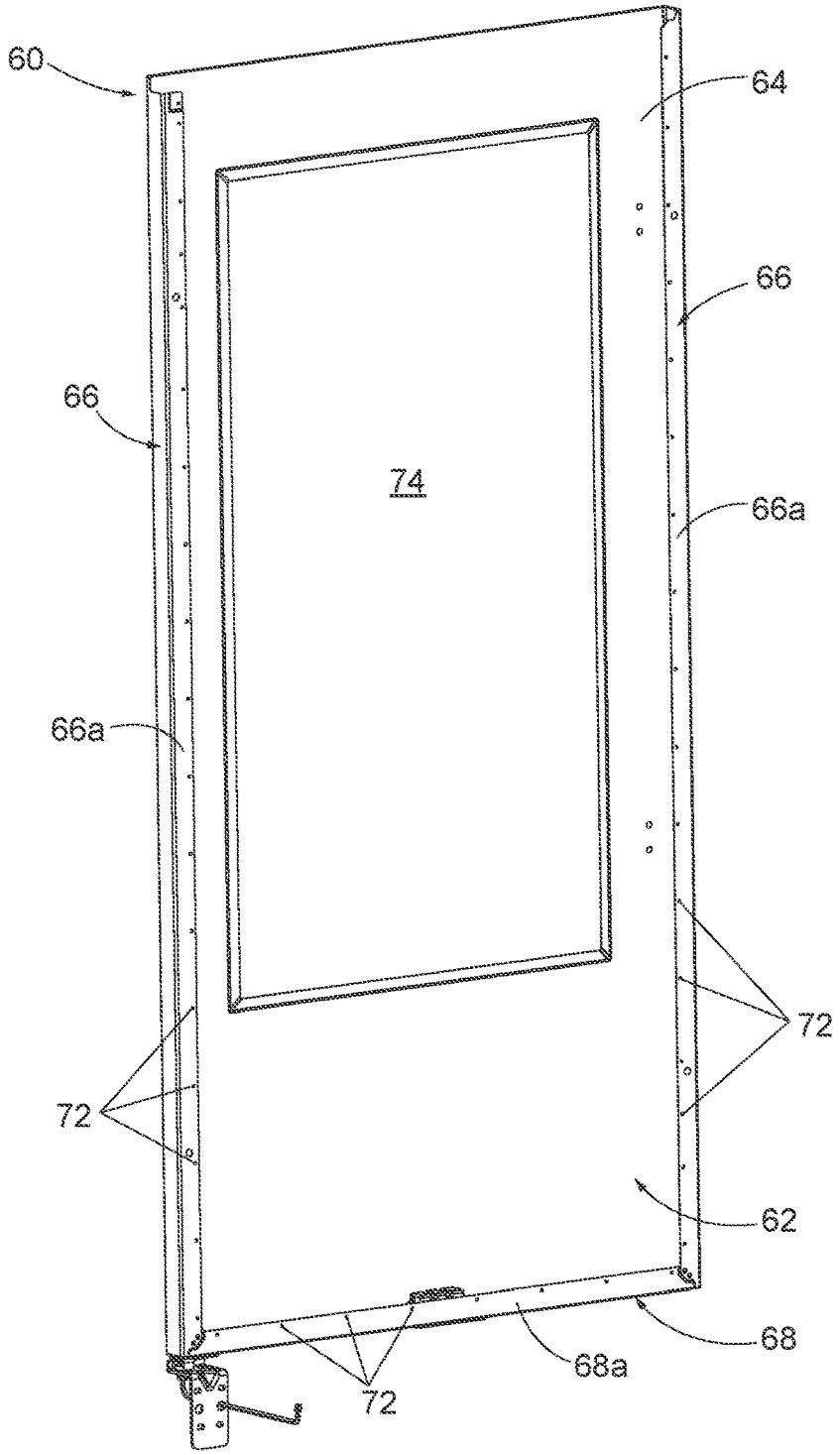
FIG. 6 is a rear perspective view of a door panel assembly of the door shown in FIG. 5.

The outer panel assembly 60 defines a front of the door 50, i.e., the portion of the door 50 facing a user when the door 50 is in the closed position. This may also be referred to as the door skin. Referring now to FIG. 6, the outer panel assembly 60 includes a panel 62 that can be made of a rigid and durable material, such as steel, stainless steel or aluminum, plastics or even glass, to provide an aesthetically pleasing appearance and feel for a consumer.

The panel 62 is formed to define a front 64 and opposing sides 66 and a bottom 68 that extend in a generally perpendicular direction from the sides and lower edge of the front 64, respectively. The top edge of the panel 62 can be left open. Inwardly extending flanges 66*a*, 68*a* are formed along the edges of the opposing sides 66 and the bottom 68, respectively. The panel 62 may be formed from a single sheet of material, whereby the various preceding elements are provided by bending the sheet to form the sides, edges, flanges, etc. Prior to bending, slits or slots may be made in the sheet to facilitate the bending, especially about each corner. A plurality of spaced-apart mounting holes 72 may optionally extend through the flanges 66*a*, 68*a* for mounting the panel 62 to the liner assembly 250, as described in detail below. An opening 74 extends through a central portion of the front 64 and is dimensioned and positioned as described in detail below. The opening 74 can be rectangular in shape or any other shape, including circular, oval, square, triangular, polygonal, curved, random, etc., and include corners that are rounded, angled, squared, etc.

Figure 7:
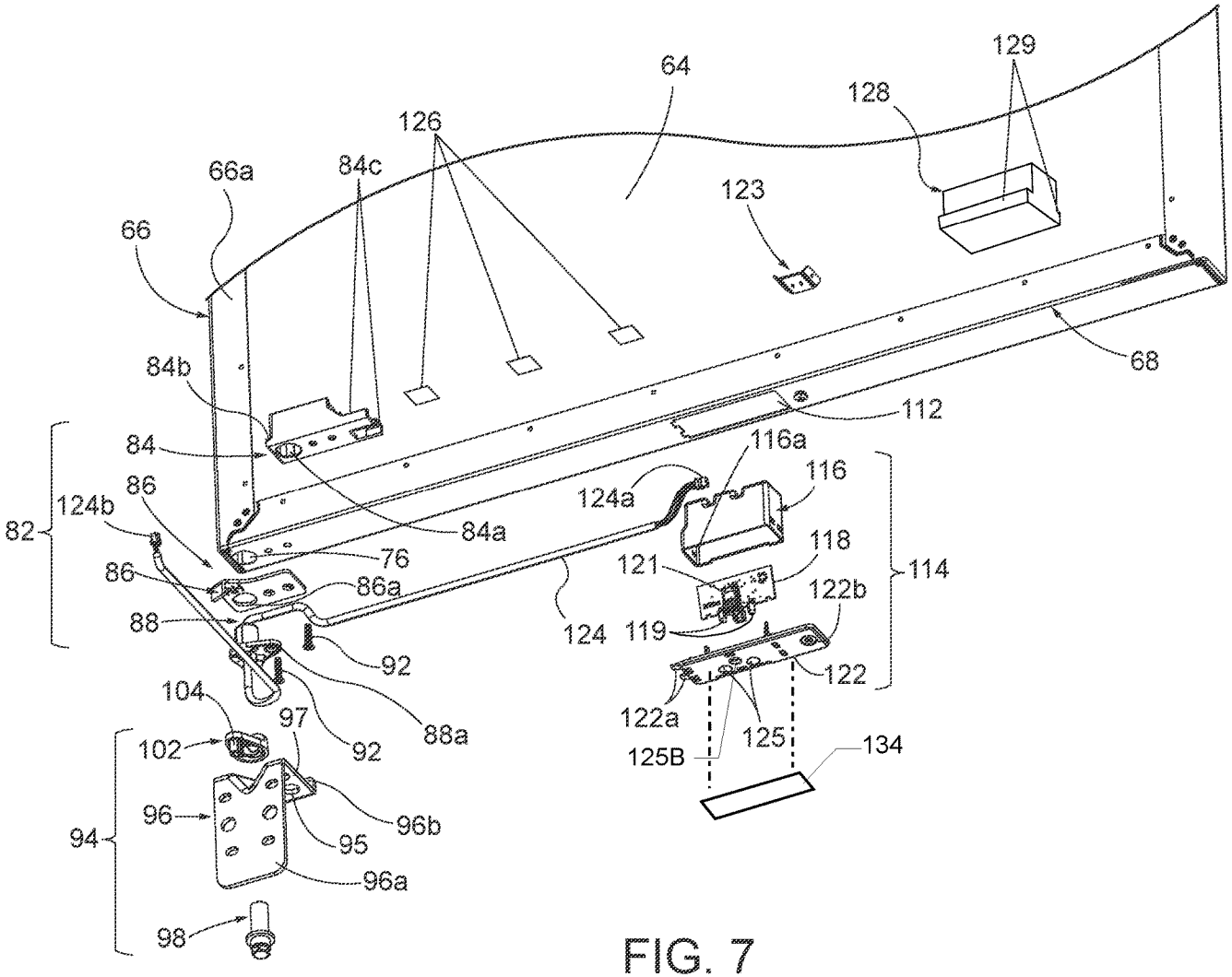
FIG. 7 is an exploded view of a lower portion of the door panel assembly shown in FIG. 6.

Referring now to FIG. 7, which shows a lower edge of the door, an opening 76 extends through one corner of the bottom 68 of the panel 62 for a door hinge assembly. The opening 76 can be circular in shape or any other shape that can accommodate the mounting of an upper hinge assembly 82 to the panel 62. The upper hinge assembly 82 engages a lower hinge assembly 94 that is mounted to the cabinet 16 of the refrigerator 10. The upper hinge assembly 82 and the lower hinge assembly 94, together, define a lower hinge axis of the door 50. Relative pivoting of the upper and lower hinge assemblies 82, 94 permit the door 50 to pivotally open and close the refrigerator cabinet.

The upper hinge assembly 82 includes an upper block 84 disposed within an interior of the door, a plate 86 disposed on an exterior of the door, and a bushing 88. The upper block 84 is positioned in a pocket formed in a lower corner of the panel 62. The pocket is defined within the panel 62 by the bottom 68, the side 66 and the corresponding flanges 68*a*, 66*a*. A hole 84*a* is formed in a lower surface of the upper block 84 and is dimensioned and positioned to be in registry with the opening 76 in the bottom 68 of the panel 62. A lip 84*b* extends along a lower edge of one side of the upper block 84 and two legs 84*c* extend outwardly from an opposite side of the upper block 84. The upper hinge assembly 82 is positioned such that the lip 84*b* is placed next to the side 66 and the two legs 84*c* face away from the side 66. The lip 84*b* and the two legs 84*c* are provided for spacing the frame assembly 140 (FIG. 5) from the bottom 68 of the panel 62, as described in detail below. Optionally, the upper block 84 includes formed-in screw bosses (not shown) for securing the exterior plate 86 to the panel 62, as described in detail below.

The exterior plate 86 is positioned on a lower surface of the bottom 68 of the panel 62. A hole 86*a* in the plate 86 is positioned and dimensioned to be in registry with the opening 76 in the bottom 68 and the hole 84*a* in the upper block 84. The bushing 88 (or any other rotational support, such as a bearing) includes a cylindrical portion that extends through the hole 86*a* of the plate 86, through the opening 76 of the bottom 68 and into the hole 84*a* of the upper block 84. A mounting tab 88*a* extends outwardly from a lower end of the bushing 88 for securing the bushing 88 to the bottom 68 of the panel 62. Optionally, a cam feature is formed in a lower surface of the bushing 88 and is dimensioned to engage a corresponding cam feature in a cam element 102 of the lower hinge assembly 94, as described in detail below. Fasteners 92 are provided for securing the bushing 88, the plate 86 and the upper block 84 to the bottom 68 of the panel 62. It is contemplated that the fasteners 92 may extend into the formed-in screw bosses (not shown) in the upper block 84. The fasteners 92 can be screws, bolts, clips, clasps, other mechanical fasteners, etc. It is also contemplated that the bushing 88, the plate 86 and the upper block 84 can be assembled using other attachment methods, such as, but not limited to, press-fits, snaps, threads, etc. Lastly, the plate 86 further includes a projection that acts as a door stop to limit the maximum angle of rotation for opening the door 50.

Figure 3:
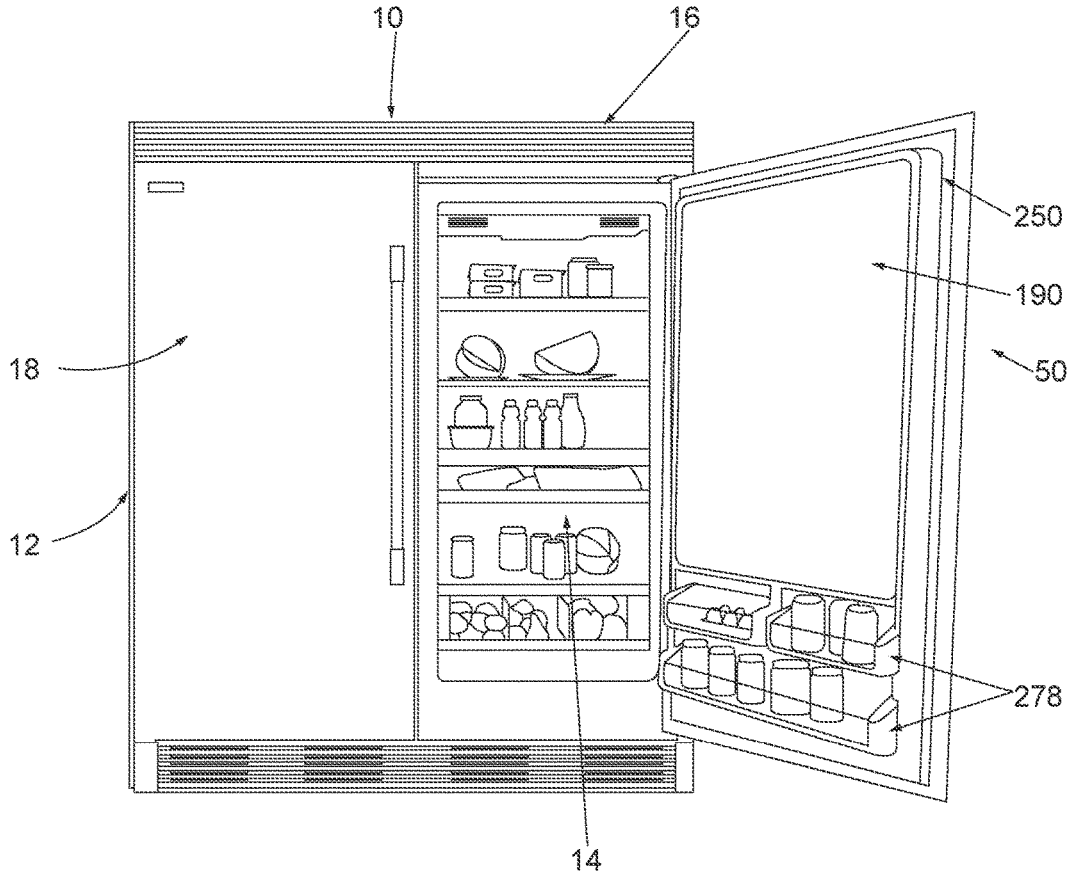
FIG. 3 is a front view of the refrigeration appliance of FIG. 1 showing a door of the fresh food compartment in an open position.

The lower hinge assembly 94 is fixedly mounted to the cabinet 16 of the refrigerator 10 (FIG. 1). The lower hinge assembly 94 includes a bracket 96, a pivot pin 98 and the cam element 102. The bracket 96 is mounted to the cabinet 16 below the door 50. In the embodiment shown, the bracket 96 is L-shaped and includes a vertical leg 96*a* mounted to the cabinet 16 and a horizontal leg 96*b* for receiving the pivot pin 98, although various configurations are contemplated. The pivot pin 98 defines a lower pivot axis of the door 50 and extends through a hole in the horizontal leg 96*b* of the bracket 96 and through the cam element 102. Optionally, either or both of the bracket 96 and pivot pin 98 can be vertically or horizontally adjustable to enable the door 50 to be vertically or horizontally adjustable relative to the cabinet 16. The door 50 is mounted to the cabinet 16 such that the pivot pin 98 extends into one of two openings 95 (only one opening 95 shown in FIG. 7) in the bushing 88 of the upper hinge assembly 82. The cam element 102 includes a downward extending protrusion 104 that is dimensioned and positioned to be received into one of two mating openings 97 (only one opening 97 shown in FIG. 7) in the horizontal leg 96*b* of the bracket 96. The protrusion 104 and the mating opening 97 are positioned to lock or secure the cam element 102 into a predetermined angular orientation. The cam feature on the bottom of the bushing 88 of the upper hinge assembly 82 is dimensioned and configured to engage the cam element 102 to define one or more detents at predetermined angles of rotation of the door 50. A first detent can correspond to the door 50 being in a closed position relative to the cabinet 16 (FIG. 1) and a second detent can correspond to the door 50 being in an open position relative to the cabinet 16 (FIG. 3).

An opening 112 extends through the bottom 68 of the panel 62 of the door 50. In the embodiment shown, the opening 112 is located at a central area of the panel 62, i.e., mid-way between the opposing sides 66 and is rectangular-in-shape. It is contemplated that the opening 112 can be positioned at other lateral locations away from the central area, such as towards the corners, and may also have other geometries. A sensor assembly 114 is configured to be mounted in the opening 112. The sensor assembly 114 includes a housing 116, a sensor board 118, a cover 122 and a wire harness 124, and optionally a sensor cover plate 134. The housing 116 extends through the opening 112 into the space defined between the front 64 and the flange 68*a*. A plurality of snaps can be used to secure the housing 116 in the opening 112. It is also contemplated that other attachment methods, such as fasteners or an interference fit between the housing 116 and the bottom 68 can be used to secure the housing 116 into the opening 112.

The sensor board 118 is dimensioned to be mounted or received into the housing 116. The sensor board 118 includes a sensor 119 for detecting the presence of an object, such as a user's foot, at a predetermined location 20 (FIGS. 1 and 2) about the door 50. Although the following discussion is provided with the sensor configured as a foot-detection device, it is contemplated that the sensor could be relocated on the refrigerator to detect a different part of the body, such as a hand, arm, leg, or head sensor using similar structure or methodology. The sensor 119 can be a touch sensor or proximity sensor, for example, an infrared (IR), capacitive, capacitive displacement sensor, eddy-current, inductive, laser rangefinder, magnetic, passive optical, passive thermal infrared, photocell (reflective), radar, sonar, ultrasonic, hall effect, capacitive touch, camera, or similar sensor. It is contemplated that the sensor 119 can include a transmitting element for sending a signal (e.g., an infrared signal) and a receiving element for detecting the signal. The sensor 119 (or sensor board 118) can provide a signal to a controller 30, 34, 36 (FIGS. 18-19) of the refrigerator 10 when an object, e.g., a user's foot, is detected by the sensor (e.g., interrupts or modifies the transmission of the signal between the transmitting element and the receiving element, or a signal sent by the transmitting element is reflected by the foot to the receiving element). In one embodiment, the sensor is able to self-adjust sensitivity based on the local environment where the refrigerator is placed. In addition or alternatively, the detection sensitivity of the sensor 119 can be adjustable, by a service technician or possibly by the user, based upon the local environment where the refrigerator is place. It is also contemplated that the sensor board 118 can include a light or light emitting diode (LED) 121 that illuminates a target area on the floor. In one example, the illumination can highlight the target area with a spotlight. In another example, the illumination can display an image (or multiple images) on the floor, such as a symbol, word, letter, number, picture, time-of-day/clock/date, countdown timer to indicate how long the interior light of the cabinet will remain illuminated, combinations thereof, or any other object(s) that can be easily perceived by the user. In one example, while waiting for user interaction, the sensor illumination can display a symbol upon the target area, and then upon triggering the sensor by the user to turn on the interior cabinet lights, the sensor illumination can subsequently switch to displaying a countdown timer to indicate how long the interior light of the cabinet will remain illuminated. It is contemplated that this illumination can have a predefined or user-selectable color, e.g., blue or red, to contrast the color of the floor and make the illumination or image easily visible to the user. This illumination defines the location 20 on the floor that the sensor is monitoring for the presence of an object, e.g., the user's foot, to help guide the user.

Figure 23B:
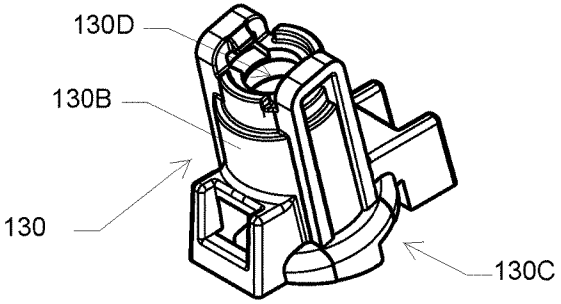
FIGS. 23A-D illustrate an example optic system.
Figure 23D:
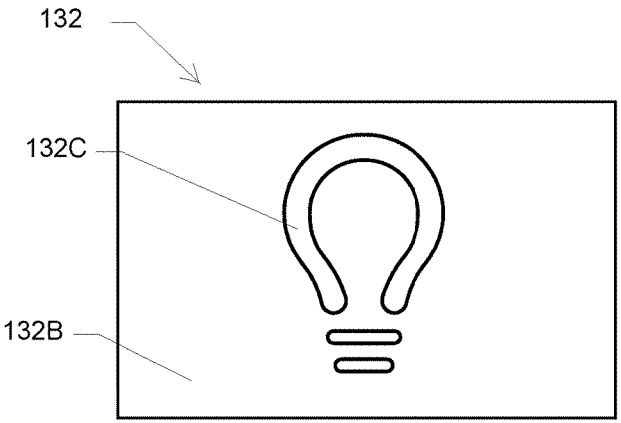
Figure 23A:
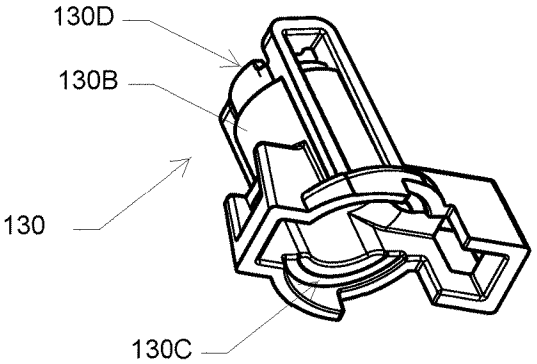
Figure 23C:
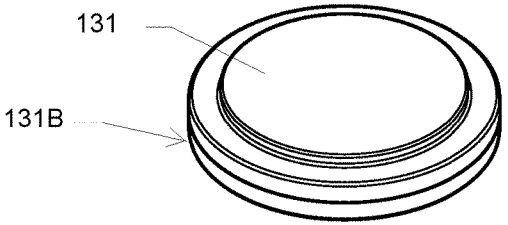

Optionally, as shown in FIGS. 23A-D, an optic system 130 can be utilized between the light or light emitting diode (LED) 121 and the cover 122. The optic system 130 may be part of the light assembly, or may be a separate component. The optic system 130 can include a housing 130B that attaches to the light or light emitting diode (LED) 121 (e.g., at an upper end 130D thereof), and into which is attached one or more lens(es) 131 (e.g., at a lower end 130C thereof) configured to project the illumination upon the target area with the proper optic length suitable to present a crisp, in-focus display. Preferably, the light and lens are in optic alignment. It is contemplated that focus of the lens(es) can be fixed, or can be configured for automatic or manual adjustment. In one example, the lens 131 can include a raised or recessed ridge 131B around a perimeter thereof that snap-fits into a corresponding raised or recessed structure in the opening 130C of the housing 130B. Other suitable mechanical retention systems, or adhesives or welding, are contemplated for the lens 131. The optic system 130 can further include a static or dynamic imager 132, which can project the desired image (or multiple images) on the floor. By static, is it understood that the projected image will be fixed or stationary and not change over time, and by dynamic, it is understood that the projected image will actively change or move over time (e.g., changing images, moving images, video, etc.). It is understood that multiple successive static images can be used, whereby each individual image is fixed or stationary, but the actual image projected can change over time. The imager 132 is disposed within the housing 130 at a position in between the light emitting diode (LED) 121 and the lens 131, whereby the light from the LED 121 first passes through the imager 132 before passing through the lens 131 and onto the floor. Of course, it is contemplated that the imager 132 could alternatively be located downstream from the lens 131. Where a static image is desired, the imager 132 can be a static "stencil" (of any graphic/number/symbol/text) to be projected onto the floor via pass-through illumination. For example, as shown in FIG. 23D, the static imager can include a substrate 132B with the desired image 132C thereof. Although shown as having a rectangular geometry, the substrate may also have other geometries, such as circular, oval, square, triangular, polygonal, curved, random, etc. and may correspond to the interior of the housing 130B. In one example, the static imager 132 is a microfilm with a translucent or transparent substrate 132B onto which is printed the desired image 132C. In another example, the static imager 132 has an opaque metal or plastic substrate 132B onto which is etched a translucent or transparent desired image 132C so that light can pass through only the etching. Where a dynamic image is desired (e.g., a countdown timer), the imager 132 can be dynamic projection display, such as a projection LCD via pass-through illumination, to project the changing display onto the floor.

The cover 122 is attached to the housing 116 and/or the bottom 68 for enclosing the housing 116. The cover 122 can include tabs 122*a* at one end for engaging mating openings 116*a* in the housing 116. A hole 122*b* can be formed in an opposite end of the cover 122 for receiving a fastener (not shown) for securing the cover 122 to a hole in the bottom 68 or to an anchor nut 123 (disposed on an upper surface of the bottom 68). It is contemplated that the cover 122 can be secured to the bottom 68 and/or the housing 116 using other attachment methods, such as snap-fits, screws, interference fits, etc. The cover 122 can include a plurality of openings 125, 125B for the sensor 119 and/or the light 121, respectively. Optionally, a sensor cover plate 134 can be used to allow the user to cover the light 121 and/or sensor 119 if the user does not want either or both of these options enabled.

Figure 20:
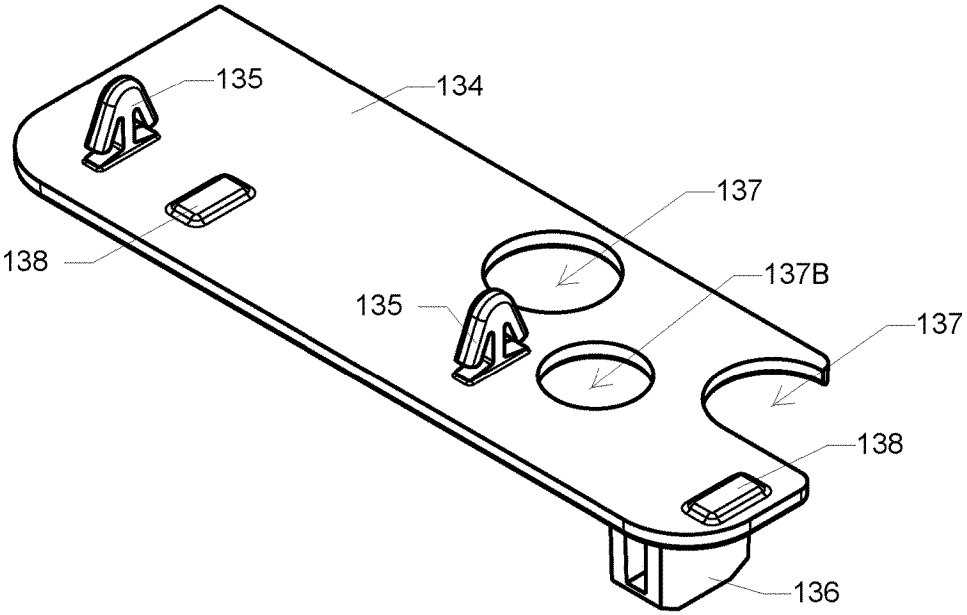
FIG. 20 illustrates an example sensor cover plate.
Figure 22:
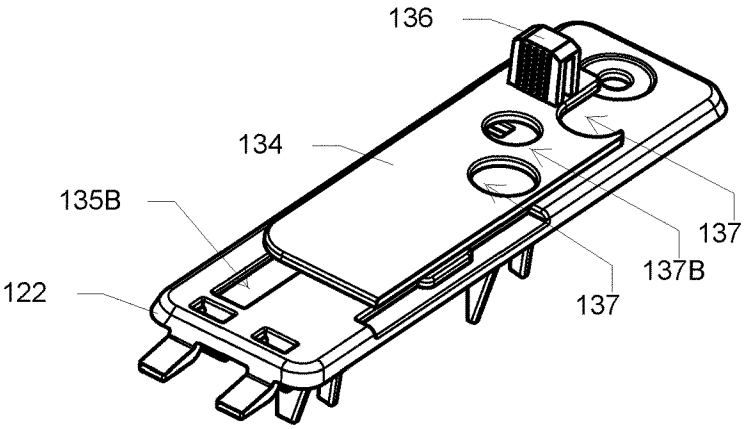
FIGS. 21-22 illustrate example positions of the sensor cover plate.
Figure 21:
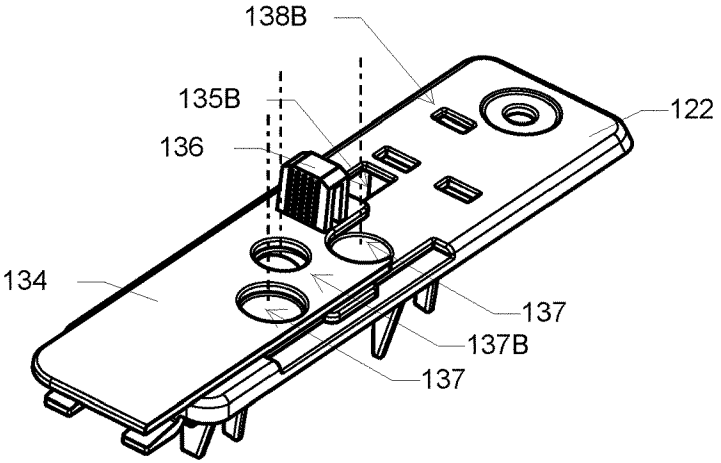

Turning now to FIGS. 20-22, the sensor cover plate 134 is shown in more detail. Although the following description and drawings illustrate a sensor cover plate that is operable via a sliding motion, it is contemplated that the sensor cover plate can have various other configurations that are user selectable to cover the light 121 and/or sensor 119, such as a hinged/pivotable cover, bi-fold cover, a non-movable snap-on or screw-down cover, a cover of multiple elements, individual plugs for the openings 125, 125B, etc.

In one embodiment, the sensor cover plate 134 can be a mechanical slide that is slidably affixed to the bottom of the cover 122. For example, the sensor cover plate 134 can include one or more projection legs 135 that slidably engage open slide channels 135B in the cover 122. As shown, the projection legs 135 can have a snap-lock configuration (e.g., resiliently flexible spring legs) to enable easy assembly into the slide channels 135B that inhibits removal of the sensor cover plate 134 from the cover 122 (e.g., the spring legs expand wider than the width of the slide channel). The sensor cover plate 134 further includes a handle 136 to enable easy sliding manipulation by the user. The sensor cover plate 134 includes through holes 137, 137B that are aligned to be in registry with the openings 125, 125B, respectively, when the sensor cover plate 134 is arranged upon the cover 122. The holes 137, 137B can have a circular geometry, as shown, or may also have other geometries, such as oval, square, triangular, polygonal, curved, random, etc. Optionally, with a sliding cover, some or all of the holes 137, 137B can have an elongated geometry (e.g., oval or parabolic) to selectively allow use of certain openings 125, 125B while dis-allowing certain other openings 125, 125B. Lastly, the sensor cover plate 134 can include one or more position detents 138 that can mate with corresponding recesses 138B on the cover 122 depending upon the position of the sensor cover plate 134. The position detents can provide feedback to help guide a user in moving the sensor cover plate 134 to a desired position.

Turning now to FIGS. 21-22, sliding operation of the sensor cover plate 134 is illustrated. In FIG. 21, the sensor cover plate 134 is in a first position whereby the all of the holes 137, 137B are in registry with the corresponding openings 125, 125B of the cover 122. In this position, the sensors 119 can transmit and receive signals via the openings 125 and holes 137, while the light emitting diode (LED) 121 can illuminate the floor via the opening 125B and 137B. Next, in FIG. 22, the sensor cover plate 134 is moved to a second position (e.g., slid towards the right in the drawing) whereby the all of the holes 137, 137B are mis-aligned with the corresponding openings 125, 125B of the cover 122. In this second position the opaque surface wall of the sensor cover plate 134 blocks transmission of light and/or signals from the sensors 119 and the light emitting diode (LED) 121. The second position thereby defeats and effectively disables use of the sensors 119 and the light emitting diode (LED) 121. Optionally, the controller 30, 34 can detect use of the sensor cover plate 134 by analysis of the signals received and can activate or deactivate the sensor assembly 114, or alternatively, the movement of the sensor cover plate 134 can be detected by a switch (not shown, triggered by moving the plate 134 to the first or second position) that is sensed by the controller 30, 34 to activate or deactivate the sensor assembly 114.

It is to be appreciated that the sensor cover plate 134 can enable and disable certain features, while maintaining others. In one example, where a user wishes to disable only the illumination from the light emitting diode (LED) 121, but still enable operation of the sensors 119, the holes 137 can have an elongated geometry (e.g., oval or parabolic) so that they remain in registry with the openings 125 whether the sensor cover plate 134 is slid left or right. In this manner, the sensors 119 can still transmit and receive signals through the openings 125 and holes 137. However, the hole 137B may only have a circular geometry so that, when the sensor cover plate 134 is slid left or right, the hole 137B is then mis-aligned with the opening 125B such that illumination from the light emitting diode (LED) 121 is blocked by the opaque surface wall of the sensor cover plate 134.

Conversely, in another example where a user wishes to disable the sensors 119 but retain the illumination from the light emitting diode (LED) 121, the holes 137 can be circular and the hole 137B can be elongated (e.g., oval or parabolic). Thus, by sliding the sensor cover plate 134 left or right, the signals from the sensors 119 are blocked via mis-alignment of the holes 137 with the openings 125, while the illumination from the light emitting diode (LED) 121 can still pass through the opening 125B and hole 137B.

Instead of elongated holes 137, 137B (e.g., oval or parabolic), it is further contemplated that the sensor cover plate 134 can have multiple additional holes (not shown) that are only used when the sensor cover plate 134 is in one of the predetermined first and second positions (or optionally in third or more other positions of the sensor cover plate 134). For example, as shown in FIG. 22, all of the holes 137, 137B are mis-aligned with the openings 125, 125B. Instead, the multiple additional holes could be positioned to be in alignment with a desired opening 125, 125B is in one of the predetermined first and second positions. For example, as shown in FIG. 22, there could be an additional hole 137B that would be in alignment with the opening 125B to thereby still enable use of the light emitting diode (LED) 121. When the sensor cover plate 134 is in the first position, this additional hole 137B may be unused. Similarly, there could be an additional third hole 137 that would be in alignment with one of the holes 125 so that, in either of the first and second position of the sensor cover plate 134, two of the three holes 137 would be in alignment with the openings 125 to thereby still enable use of the sensors 119.

The wire harness 124 extends through the pivot pin 98, the bushing 88 and the upper block 84 into a lower portion of the panel 62. A connector 124*a* at one end of the wire harness 124 connects to the sensor board 118 and a connector 124*b* at the other end of the wire harness 124 connects to a controller 30, 34 (shown schematically in FIGS. 18-19), or to a power assembly (not shown), that can be mounted in the lower portion of the cabinet 16 of the refrigerator 10. In one embodiment shown in FIG. 18, a separate sensor controller 34 can be used directly to selectively energize and de-energizing interior lights 22 of the cabinet 16 (shown schematically in FIG. 18) in the fresh food compartment 14, as described in detail below. In another embodiment shown in FIG. 19, the sensor 119 or sensor board 118 can be connected to the main refrigerator controller 30 to selectively energize and de-energizing interior lights 22 of the cabinet 16, without a separate sensor controller. In the embodiment shown, a single piece of tape 126 or a plurality of pieces of tape 126 is provided for securing the wire harness 124 to the upper surface of the bottom 68. In addition or alternatively, the harness 124 can have its own adhesive and/or zip ties for securing to the upper surface of the bottom 68. It is contemplated that other attachment devices, such as clips, anchors, liquid adhesives can be used to secure the wire harness 124 to the upper surface of the bottom 68 of the panel 62.

A spacer block 128 is disposed in the corner of the panel 62 opposite the upper hinge assembly 82. As described in detail below, the spacer block 128 is provided to aid in properly spacing the frame assembly 140 (FIG. 9C) above the bottom 68 of the panel 62. The spacer block 128 is a generally block-shaped element having outward extending flanges 129 formed along the lower edges of opposite sides of the block 128. The spacer block 128 is positioned in the space defined between the front 64 and the flange 68*a*. In particular, the spacer block 128 is positioned such that the flanges 129 are disposed next to the front 64 and the flange 68*a*.

Frame Assembly 140

Figure 8A:
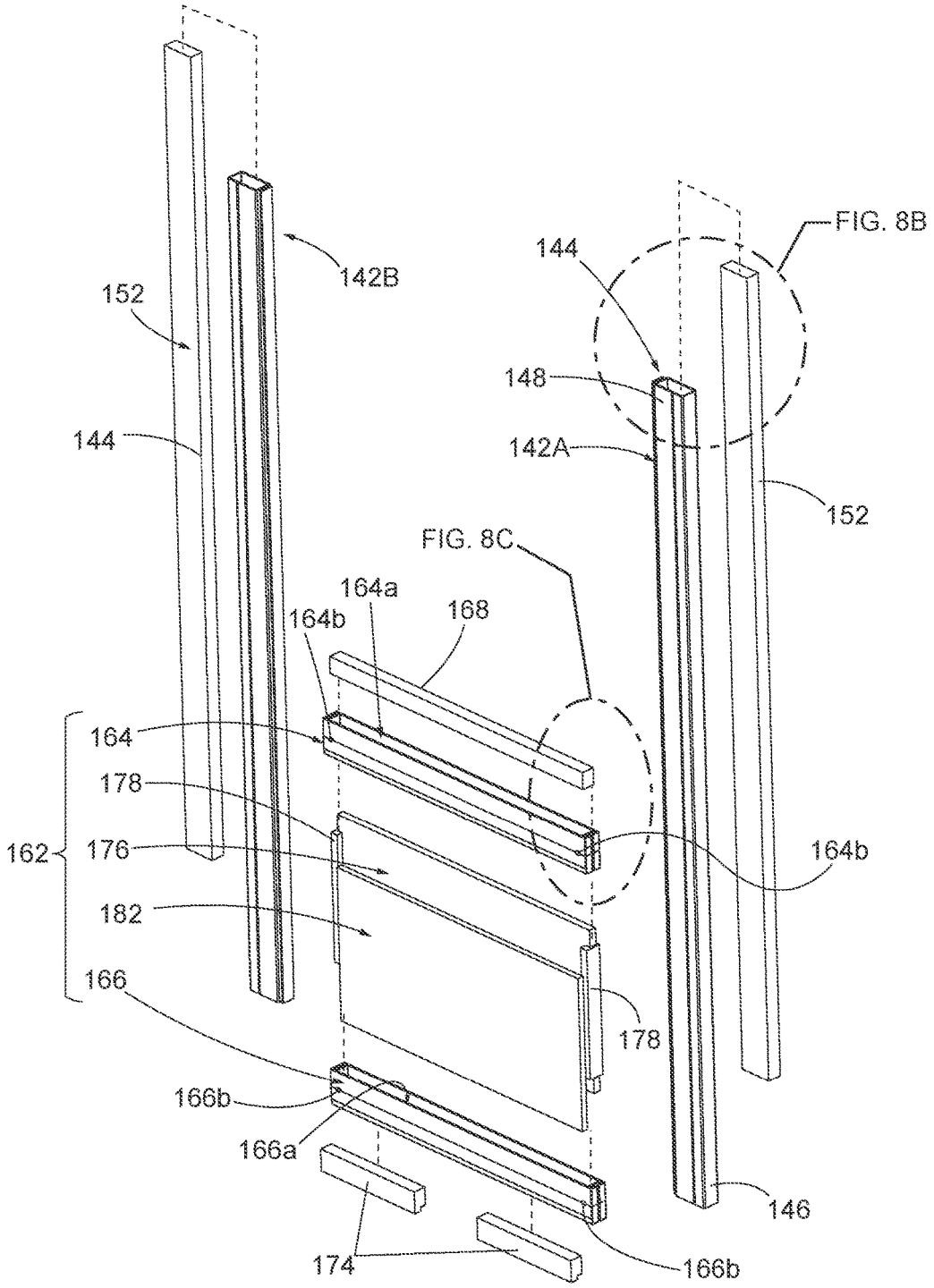
FIG. 8A is an exploded view of a frame assembly of the door shown in FIG. 5.

Referring to FIG. 8A, the internal frame assembly 140 of the door 50 includes first and second beams 142A, 142B and a lower support and insulation assembly 162. The first and second beams 142A, 142B are essentially identical and only the first beam 142A will be described in detail.

The first beam 142A is an elongated element that is generally vertically oriented. The first beam 142A can be made by extruding or molding plastic, e.g., acrylonitrile butadiene styrene (ABS), or a similar rigid material. A tab 154 (FIG. 8B) extends longitudinally along one side of the first beam 142A. In the embodiment shown, the tab 154 is T-shaped having a base portion of the "T" attached to the side of the first beam 142A and a hat portion of the "T" attached to the distal end of the base portion. A longitudinal opening 144 extends through the first beam 142A from a lower end 146 to an upper end 148 of the first beam 142A, such that the first beam 142A is hollow. In the embodiment shown, the opening 144 is rectangular in shape, although other geometries are contemplated.

An elongated insulating element 152 is dimensioned to be received into the opening 144. The elongated insulating element 152 can be made from an insulating material, such as solid, pre-formed expanded polystyrene (EPS), or a similar material. The solid EPS provides thermal insulation and additional rigidity to the first beam 142A. It is contemplated that the insulating element 152 can also be made of one or more separate pieces of insulating material, or may even be filled with a liquid expanding foam that cures rigid.

The lower support and insulation assembly 162 attaches to the tabs 154 of the first and second beams 142A, 142B. The assembly 162 includes an upper beam 164, a lower beam 166, an insulation support 176 and an optional vacuum insulation panel 182. The upper beam 164 is an elongated element having an elongated upper cavity 164*a* formed in an upper surface and an elongated lower cavity (not shown) formed in a lower surface of the upper beam 164. The upper beam 164 has a generally H-shaped cross section when viewed from the end of the upper beam 164. It is contemplated that the wall between the upper cavity 164*a* and the lower cavity (not show) could be removed such that the upper beam 164 is open from the top surface to the lower surface of the upper beam 164. It is also contemplated that the wall between the upper cavity 164*a* can be a continuous or divided into a plurality of segments between opposite ends of the upper beam 164.

The upper cavity 164*a* is dimensioned to receive a pre-formed insulating element 168. The insulating element 168 can be made from an insulating material, such as solid, pre-formed expanded polystyrene (EPS), or a similar material. An elongated slot 172 (FIG. 8C) is formed in the opposite ends of the upper beam 164. The slots 172 are vertically oriented and are dimensioned to correspond to the T-shaped tab 154 of the first beam 142A to receive the tabs 154 in the corresponding first and second beams 142A, 142B, as described in detail below. Angled holes 164*b* (FIG. 8A) can be formed in opposite ends of the upper beam 164 for receiving fasteners (not shown), as described in detail below.

Referring to FIG. 8A, the lower beam 166 is essentially identical to the upper beam 164. In the embodiment shown, the lower beam 166 includes two laterally adjacent insulating elements 174 disposed in a lower cavity (not shown) in the lower surface of the lower beam 166. The insulating elements 174 can be made from an insulating material, such as solid, pre-formed expanded polystyrene (EPS), or a similar material. The inward facing ends of the two insulating elements 174 are spaced-apart to define a space for receiving the sensor assembly 114 (FIG. 7), as described in detail below. Angled holes 166*b* (FIG. 8A) can be formed in opposite ends of the lower beam 166 for receiving fasteners (not shown), as described in detail below. An upper cavity 166*a* is formed in the upper surface of the lower beam 166. Both the upper beam 164 and the lower beam 166 can be made by extruding plastic, e.g., acrylonitrile butadiene styrene (ABS), or a similar material.

The insulation support 176 is a generally plate-shaped element having a thick central portion and spacers 178 on either end side. The insulation support 176 can be a rigid plastic plate, or can be made from an insulating material, such as solid, pre-formed expanded polystyrene (EPS). The insulation support 176 and the optional insulation panel 182 are placed face-to-face and the spacers 178 are dimensioned to properly position the insulation panel 182 on the insulation support 176. The upper edges of the insulation support 176 and the insulation panel 182 are received into the lower cavity of the upper beam 164 and the lower edges of the insulation support 176 and the insulation panel 182 are received into the upper cavity 166*a* of the lower beam 166. In this respect, the insulation support 176 and the insulation panel 182 are captured or secured between the upper beam 164 and the lower beam 166. In another embodiment, the insulation panel 182 may be eliminated, whereby only the insulation support 176 is used. In this case, insulation support 176 can be made from an insulating material, such as solid, pre-formed expanded polystyrene (EPS), or a similar material, of a thicker dimension.

Optionally, before assembling the frame assembly 140 to the panel 62, fasteners (not shown) can be inserted into holes in the panel 62. The holes can be positioned on the side of the panel 62 opposite the upper hinge assembly 82 for securing a door handle assembly 290 (FIG. 1) to an outer surface of the front 64 of the panel 62. It is contemplated that the fasteners can be captive screws, bolts, pins, etc. to which the door handle assembly 290 is secured to during a subsequent assembly step. The door handle assembly 290 is described in detail below.

Figure 8B:
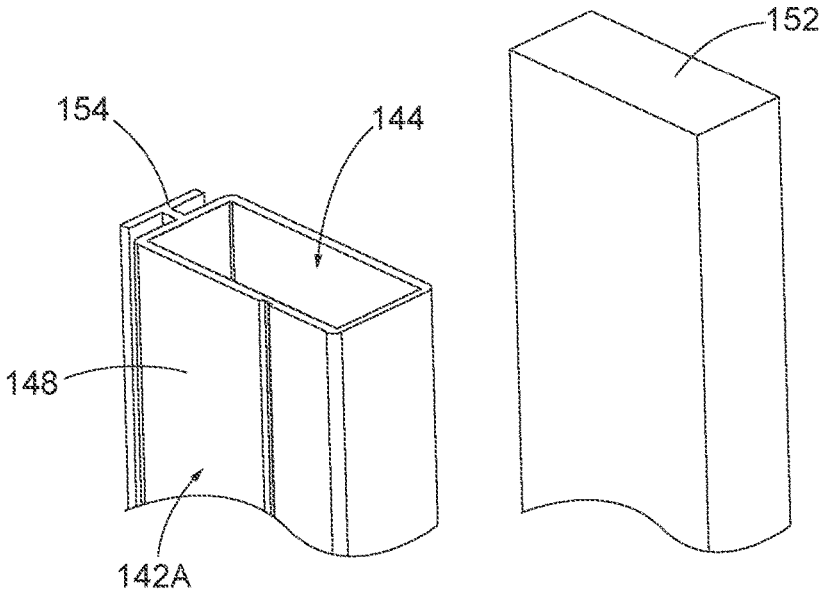
FIG. 8B is an enlarged view of a portion of the frame assembly shown in FIG. 8A.
Figure 8C:
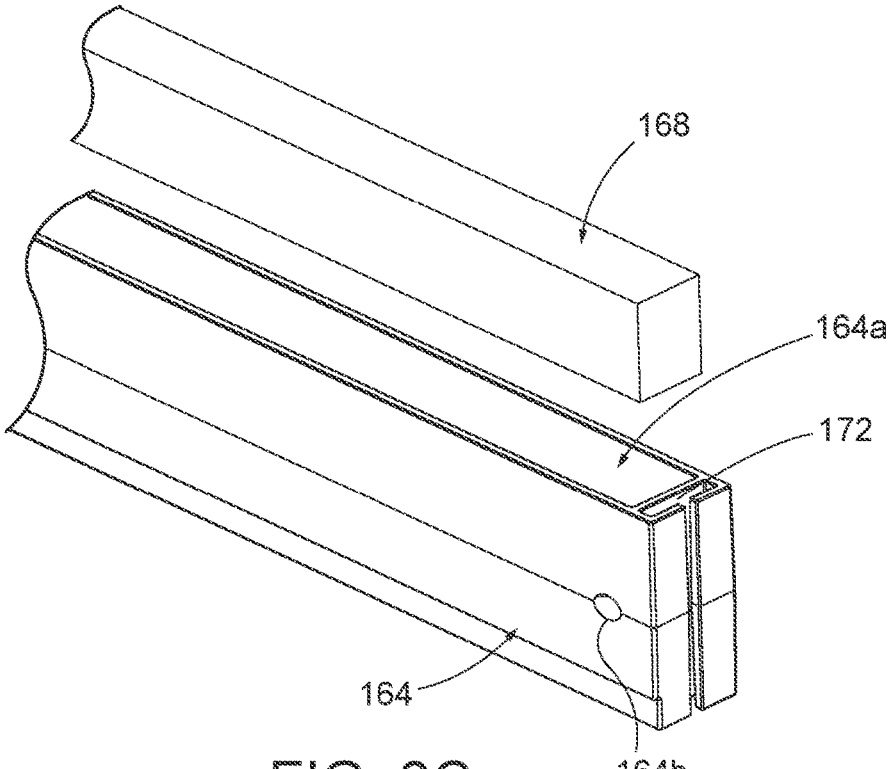
FIG. 8C is an enlarged view of a portion of the frame assembly shown in FIG. 8A.

Referring to FIGS. 8B and 8C, the frame assembly 140 is partially assembled by sliding the tabs 154 on the first and second beams 142A, 142B into the slots 172 on the ends of the upper beam 164 and the lower beam 166. It is also contemplated that alternatively the tabs and slots can be reversed such that the slots can be formed in the first and second beams 142A, 142B and the tabs can be formed in the upper and lower beams 164, 166.

Figure 9A:
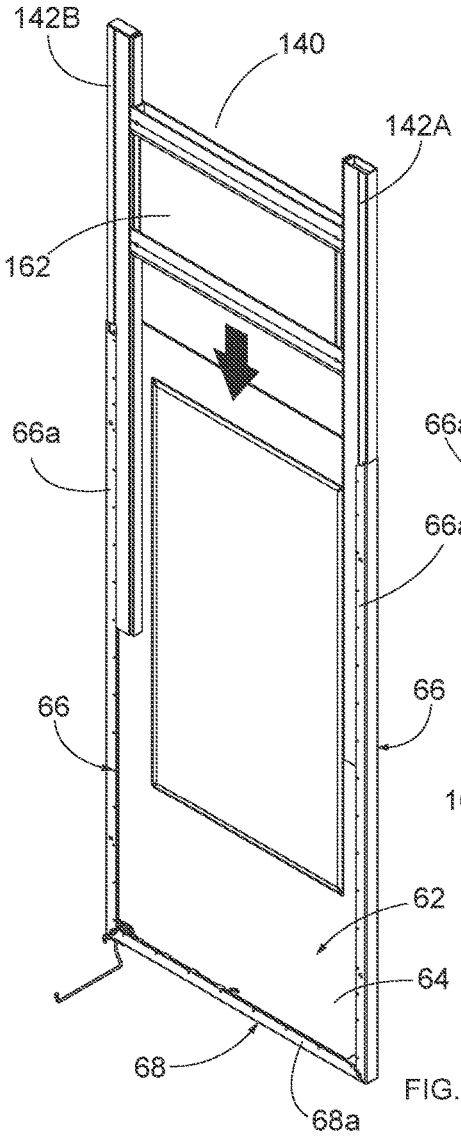
FIG. 9A is a front perspective view of the frame assembly of FIG. 8A partially inserted into the door panel of FIG. 6.

Referring to FIG. 9A, during assembly the frame assembly 140 is then slid into the panel 62 such that the first and second beams 142A, 142B are positioned adjacent the sides 66 of the door panel 62. In particular, the first and second beams 142A, 142B are positioned between the front 64 and the flanges 66*a* of the panel 62. Referring to FIG. 9C, the first beam 142A is inserted into the door panel 62 until the spacer block 128 is received into a lower portion of the opening 144 of the first beam 142A and the lower end of the first beam 142A rests on the outward extending flanges 129 of the spacer block 128. It is contemplated that elongated rails (not shown) can be formed on an interior surface of the first beam 142A to engage matching slots (not shown) on an outer surface of the spacer block 128 to secure the spacer block 128 to the first beam 142A. Referring to FIG. 9D, the second beam 142B is inserted into the door panel 62 until the upper block 84 is received into a lower portion of the opening 144 of the second beam 142B and the lower end of the second beam 142B rests on the lip 84*b* and the two legs 84*c* of the upper block 84. It is contemplated that elongated rails (not shown) can be formed on an interior surface of the second beam 142B to engage matching slots (not shown) on an outer surface of the upper block 84 to secure the upper block 84 to the second beam 142B. In this manner, the door hinge assembly 82 and weight of the door 50 is structurally supported by the second beam 142B within the door panel 62.

Figure 9B:
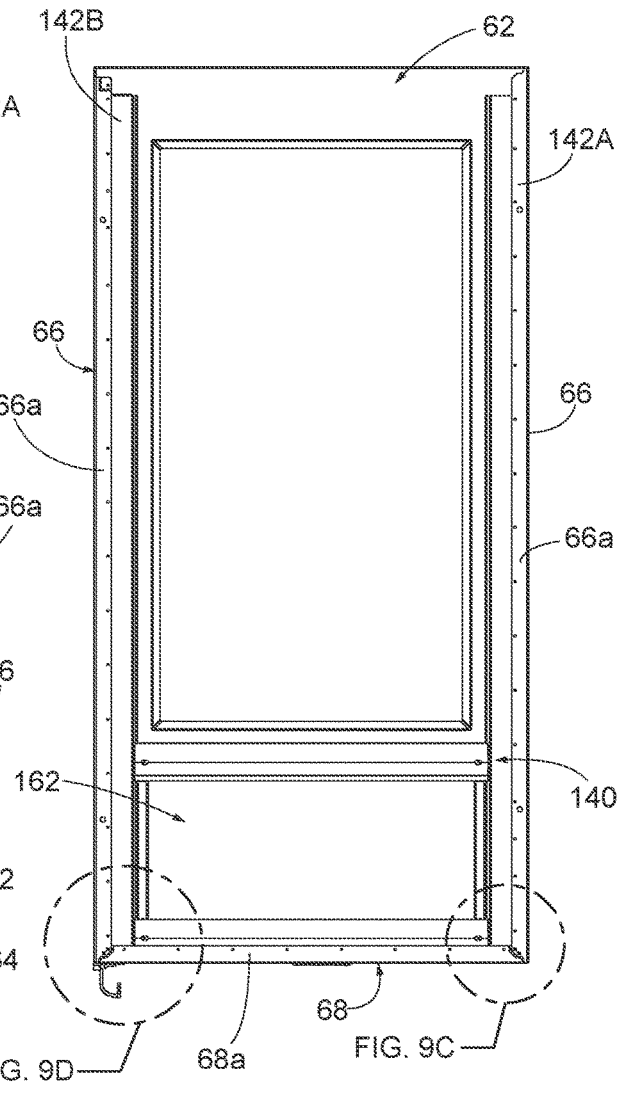
FIG. 9B is a front perspective view of the frame assembly of FIG. 8A fully inserted into the door panel of FIG. 6.
Figure 9C:
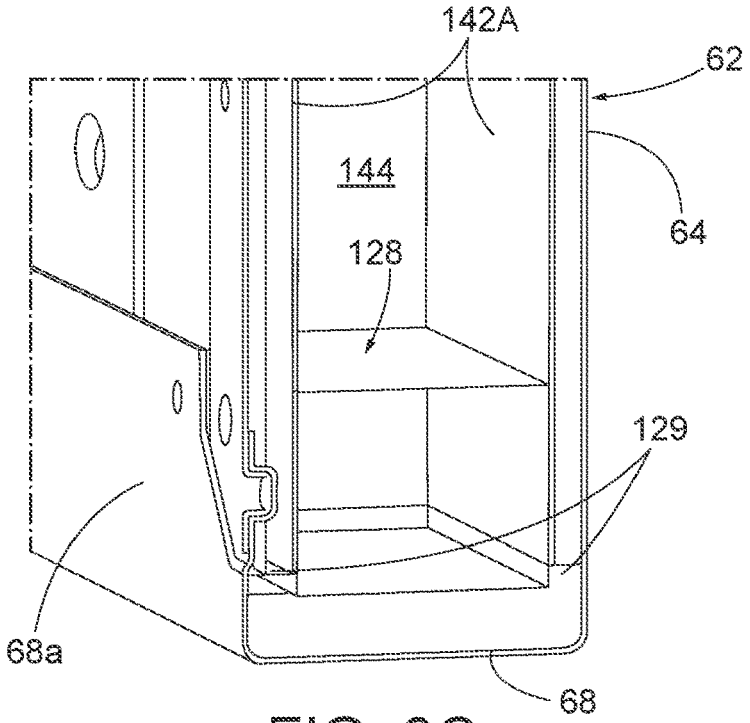
FIG. 9C is an enlarged end section view taken from FIG. 9A showing an example spacer block.
Figure 9D:
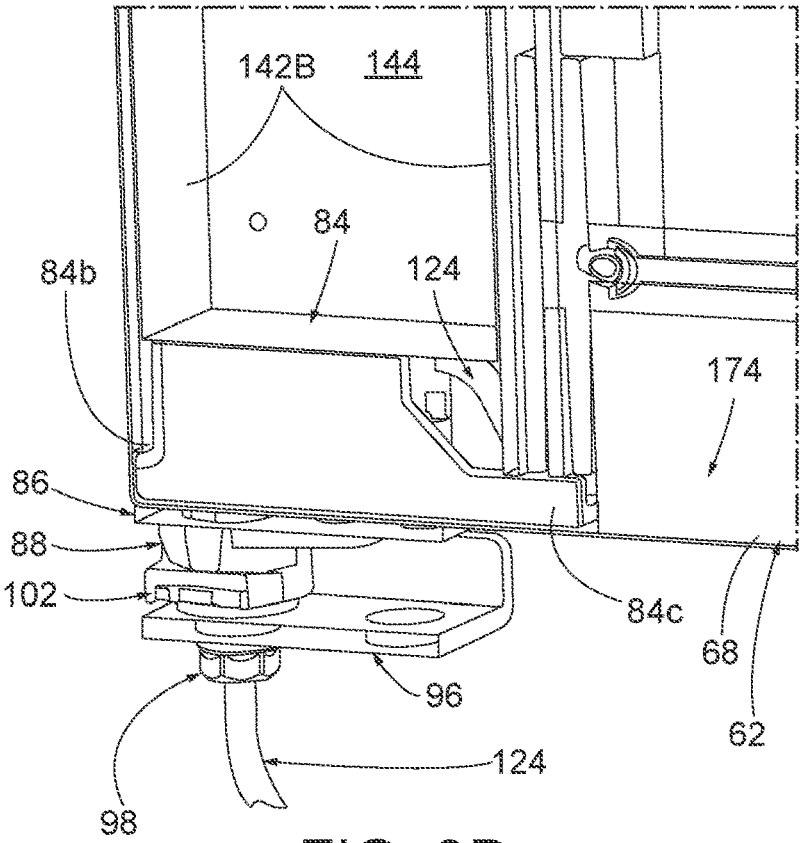
FIG. 9D is an enlarged section view taken from FIG. 9A showing an example hinge assembly.

Referring to FIG. 9B, the lower support and insulation assembly 162 is then slid downwards along the beams 142A-B to the lower portion of the door panel 62. Cooperation between the T-shaped tab 154 and corresponding slots 172 can facilitate the sliding. As discussed in detail above, the inward facing ends of the two insulating elements 174 in the lower support and insulation assembly 162 are spaced-apart to define a space therebetween (FIG. 8A). When the assembly 162 is positioned in the lower portion of the door panel 62, the sensor assembly 114 (FIG. 6) is disposed in the space defined between the inward facing ends of the two insulation elements 174. The refrigerator door 50 now has a structurally rigid internal support frame.

Window 190

Figures 10A, 10B:
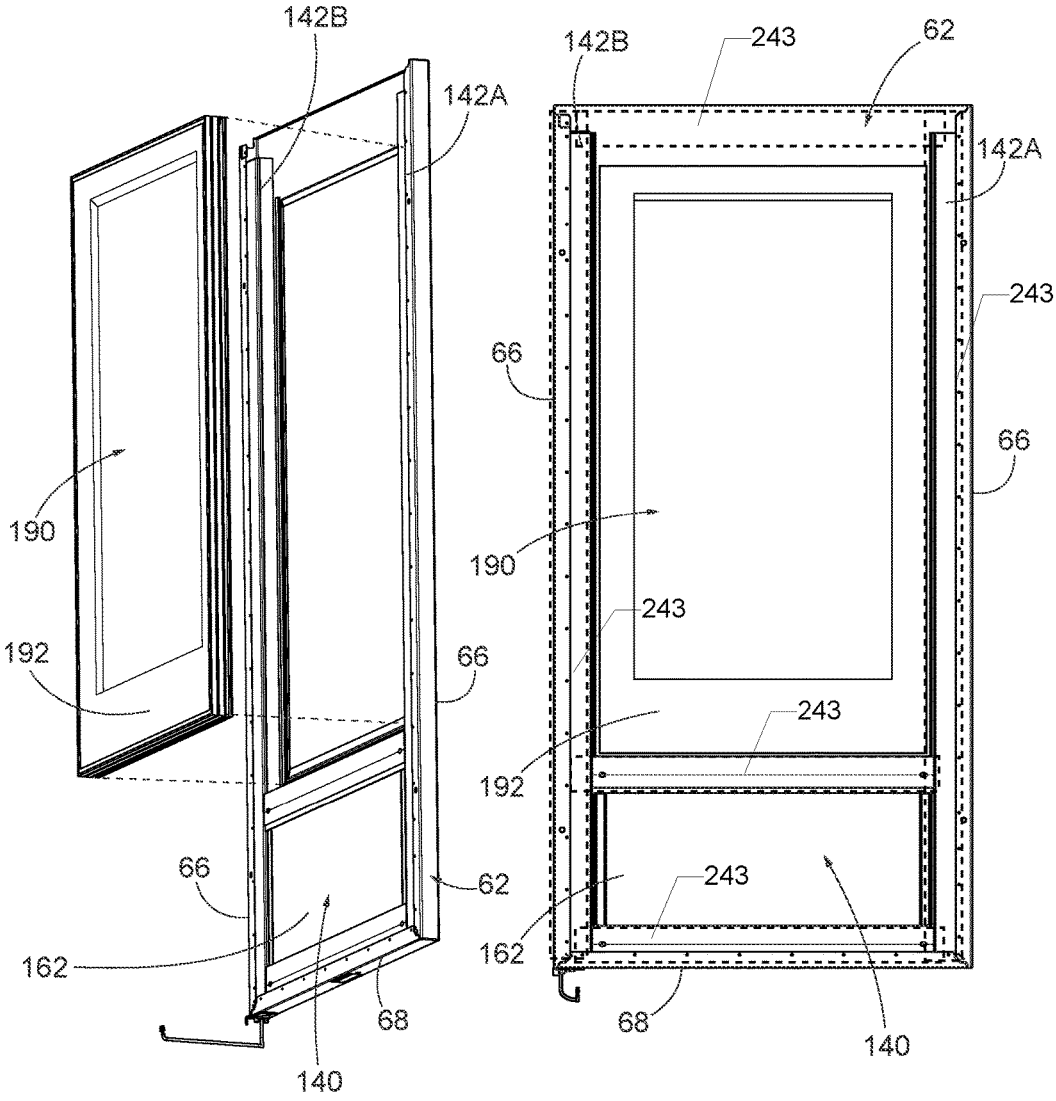
FIG. 10A is an exploded view of a window disposed adjacent to the door panel and frame assembly shown in FIG. 9B.
FIG. 10B is a front plane view of the window positioned in the door panel and frame assembly shown in FIG. 9B.

Referring now to FIGS. 10A and 10B, the window 190 is dimensioned to be received within the dimensions of the frame assembly 140. In the embodiment shown, the window 190 is a generally rectangular assembly having vertical sides that are disposed adjacent to the first and second beams 142A, 142B of the frame assembly 140. Of course, various other shapes are contemplated, including circular, oval, square, triangular, polygonal, curved, random, etc. Additionally, it is contemplated that the door 50 could include multiple windows 190 that may be connected, separate, adjacent, or spaced apart. The window 190 may or may not have a frame extending partially or completely around its periphery. A bottom of the window 190 is placed adjacent the upper side of the lower support and insulation assembly 162 of the frame assembly 140. As will be discussed below, the window 190 may be supported partially or wholly upon the door panel 62, or may be supported partially or wholly by the frame assembly 140 (such as, for example, upon one or more of the beams 142A-B or 164). In the shown example, the window 190 is secured to and supported upon the door panel 62 by an adhesive and is adjacent to, but not supported by, the frame assembly 140. In addition or alternatively, the window 190 can be secured to and supported upon the door panel 62 by mechanical features, such as clips, clasps, clamps, screws, bolts, projections, lips/ledges, etc. As shown in FIG. 10A, preferably the window 190 is assembled to the door after the frame 140 is in place, however, it is possible to install the window first. The window 190 can include a single pane of glass, or preferably may be a window pack that includes two or three (or more) window panels secured together (which may be gas-sealed and containing an inert gas, such as argon or krypton) that are designed to thermally insulate the interior of the cabinet 16 from the surrounding environment. At least one of the panels of the window 190 may include a darkened "tinted" effect to conceal the contents of the cabinet 16 of the refrigerator 10. The tinted effect inhibits ambient light from the exterior environment from illuminating the cabinet, so that the refrigerator door has a clean, darkened appearance when the interior lights are not energized. The darkening of the glass can be accomplished in various manners, such as a sputter coating, printing, applied film, etc. It is further contemplated that an opaque panel, which may include insulation, could be secured or placed in a covering relationship behind the window 190 to provide an exterior appearance of a darkened window 190, while increasing energy efficiency of the refrigerator or freezer. The window 190 may also include a low-emissivity coating to decrease heat transfer through the glass. In one embodiment, the window 190 includes a three-pane glass pack, with the darkening being applied to the interior-most window pane, and the low-emissivity coating being applied to the center or exterior window pane. Of course, it is contemplated that the various darkening, low-emissivity, or other coatings can be applied to the other various panes of a window pack.

Figure 2:
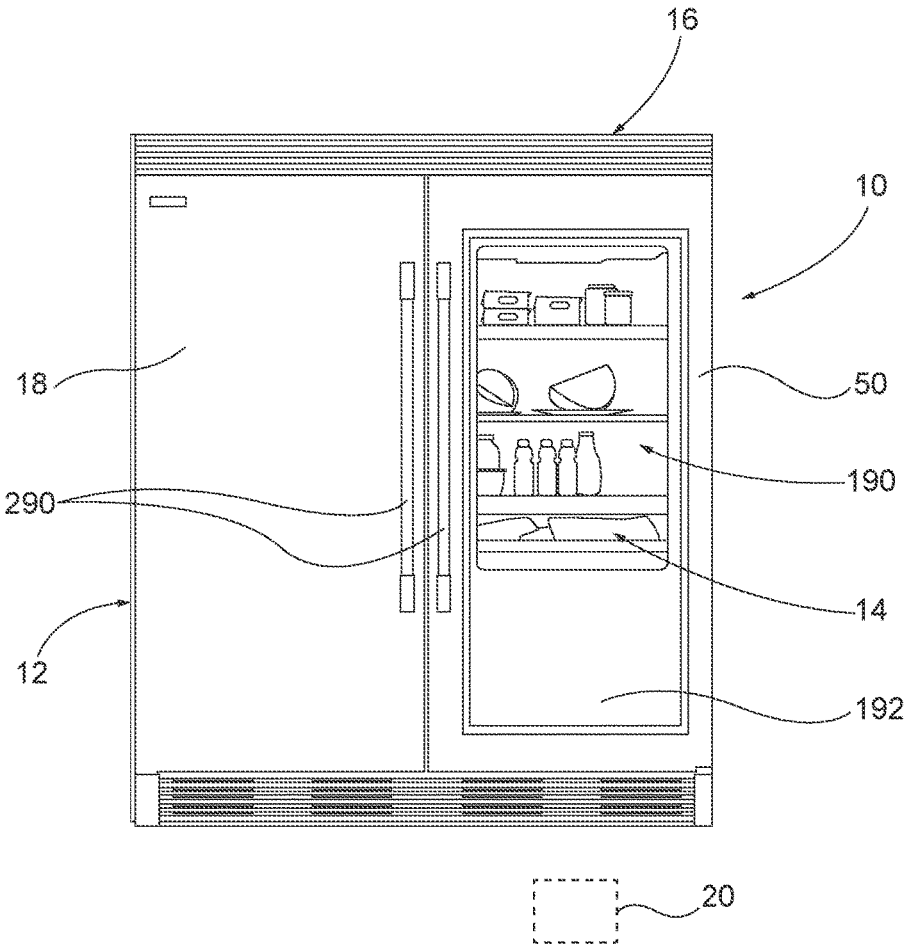

At least one of the panels of the window 190 can be tinted to inhibit viewing of the contents of the fresh food compartment 14 when the interior lights 22 (FIG. 18) of the fresh food compartment 14 is de-energized (FIG. 1) so that the fresh food compartment 14 is dark. When the interior lights 22 of the fresh food compartment 14 are energized, the window 190 is backlit so that the contents of the fresh food compartment 14 can be viewed through the window 190 without opening the door 50 (FIG. 2). It is contemplated that the window 190 can have a height that is approximately a full height of the door 50 (see FIG. 2) or approximately ¾ or ⅔ of the height of the door 50 (see FIG. 10A). Various other sizes are contemplated. Regardless of the height of the window 190 relative to the door 50, some portion of the door, such as a lower portion 192 (FIGS. 1, 2, 10A and 10B) of the window 190 (or an upper portion, or side edge portions, etc.) can be "blacked out" to be substantially or completely opaque to prevent viewing of the inside lower surface of the door 50 and/or a lower portion of the fresh food compartment 14 regardless of whether the interior lights 22 are energized or de-energized. It is contemplated that the lower portion 192 can be approximately ⅓ of the height of the window 190 (FIG. 2) or smaller (FIG. 1). As will be discussed below, the location of the blacked-out lower portion 192 may be in registry with lower door bins 302, 312. It is also contemplated that some or all of the perimeter of the window 190 can also be blacked-out to hide manufacturing details and increase the aesthetic appearance. The blacked-out portions, such as the lower portion 192 and window perimeter, can be formed by screen printing, paint, or films applied on one or more glass panels of the window 190, or may be provided by the addition of an opaque covering element, such as a solid frame or the like.

Upper Frame Assembly 210

Figure 11:
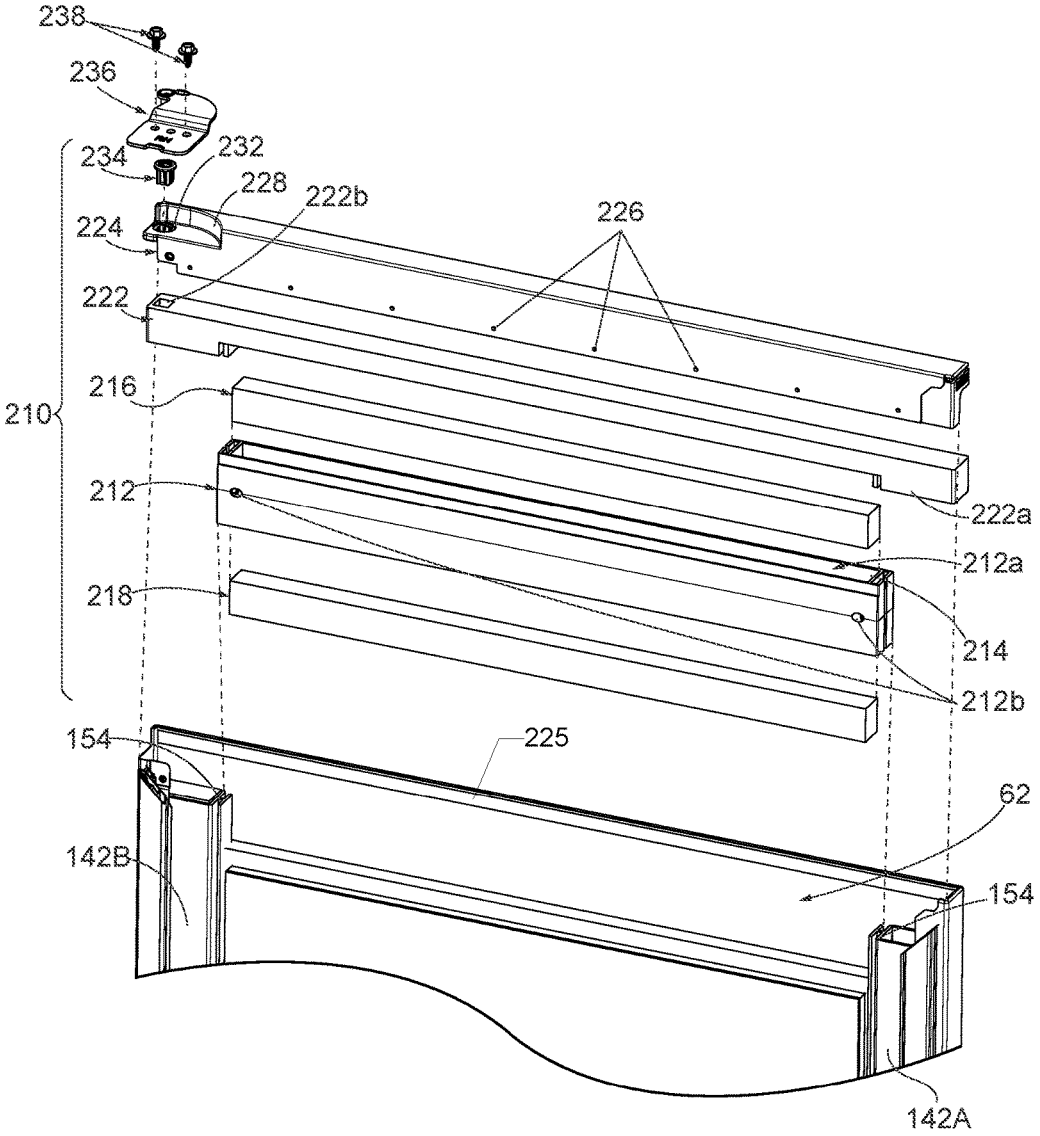
FIG. 11 is an exploded view of an upper frame assembly positioned above the upper portion of the assembly shown in FIG. 10B.

Referring to FIG. 11, an upper frame assembly 210 is used to connect the beams 142A-B together for increased structural rigidity to the door frame. The upper frame assembly 210 is inserted into an upper portion of the panel 62 above the window 190. The upper frame assembly 210 includes an upper support rail 212, first and second insulating elements 216, 218, an elongated spacer 222, an end cap 224 and a top hinge bearing 234.

The upper support rail 212 is an elongated element having an elongated upper cavity 212*a* formed in an upper surface and an elongated lower cavity (not shown) formed in a lower surface of the upper support rail 212. The upper support rail 212 has a generally H-shaped cross section when viewed from the end of the upper support rail 212. It is contemplated that the wall between the upper cavity 212*a* and the lower cavity (not shown) could be removed such that the upper support rail 212 is open from the top surface to the lower surface of the upper support rail 212. Angled holes 212*b* can be formed in opposite ends of the upper support rail 212 for receiving fasteners (not shown), as described in detail below. The upper support rail 212 can be made by extruding plastic, e.g., acrylonitrile butadiene styrene (ABS), or a similar material.

The upper cavity 212*a* is dimensioned to receive the first insulating element 216. The lower cavity (not shown) is provided for receiving the second insulating element 218. The first and second insulating elements 216, 218 can be made from an insulating material, such as solid, pre-formed expanded polystyrene (EPS), or a similar material, or may even be filled with a liquid expanding foam that cures rigid. The solid EPS provides insulating and additional rigidity to the upper support rail 212. It is contemplated that in the embodiment wherein the upper support rail 212 is open between the top surface and the lower surface of the upper support rail 212 that the first and second insulating elements 216, 218 can be replaced with a single insulating element (not shown).

An elongated slot 214 is formed on the opposite ends of the upper support rail 212. The slots 214 are vertically oriented and are dimensioned to receive the tabs 154 of the corresponding first and second beams 142A, 142B, as described in detail below.

The elongated spacer 222 is disposed above the support rail 212. The elongated spacer 222 has a lower surface 222*a* that is contoured to match the upper surface of the support rail 212 and the upper ends of the first and second beams 142A, 142B. The elongated spacer 222 can be made of an insulating material, such as fiberglass, EPS, or other rigid material. An opening 222*b* extends through one end of the elongated spacer 222 for receiving the door top hinge bearing 234.

The door end cap 224 is attached to a top surface of the elongated spacer 222. Optionally, an adhesive strip 225, such as a foam gasket with a double-sided adhesive, can be used to secure the end cap 224 to the interior of the door panel 62. The end cap 224 can be made of plastic or a similar material and closes an upper end of the door 50. An exterior surface of the end cap 224 can be contoured to provide a pleasing appearance. A plurality of spaced-apart holes 226 are formed in the side of the end cap 224 for receiving a plurality of fasteners 282 (FIG. 5), as described in detail below. A recess 228 is formed in an end of the end cap 224 and includes a hole 232 for receiving the top hinge bearing 234 (or other rotational support, such as a bushing). The recess 228 is below the upper surface of the door end cap 224 so as to hide the upper hinge assembly when viewing the refrigerator from the front. The top hinge bearing 234 is dimensioned for receiving a pivot pin (not shown) that extends from a door bracket 236. Fasteners 238 are provided for securing the door bracket 236 to the cabinet 16 (FIG. 1). The pivot pin co-axially aligns with the pivot pin 98 (FIG. 7) of the lower hinge assembly 94 for defining a common pivot axis of the door 50.

Figure 12:
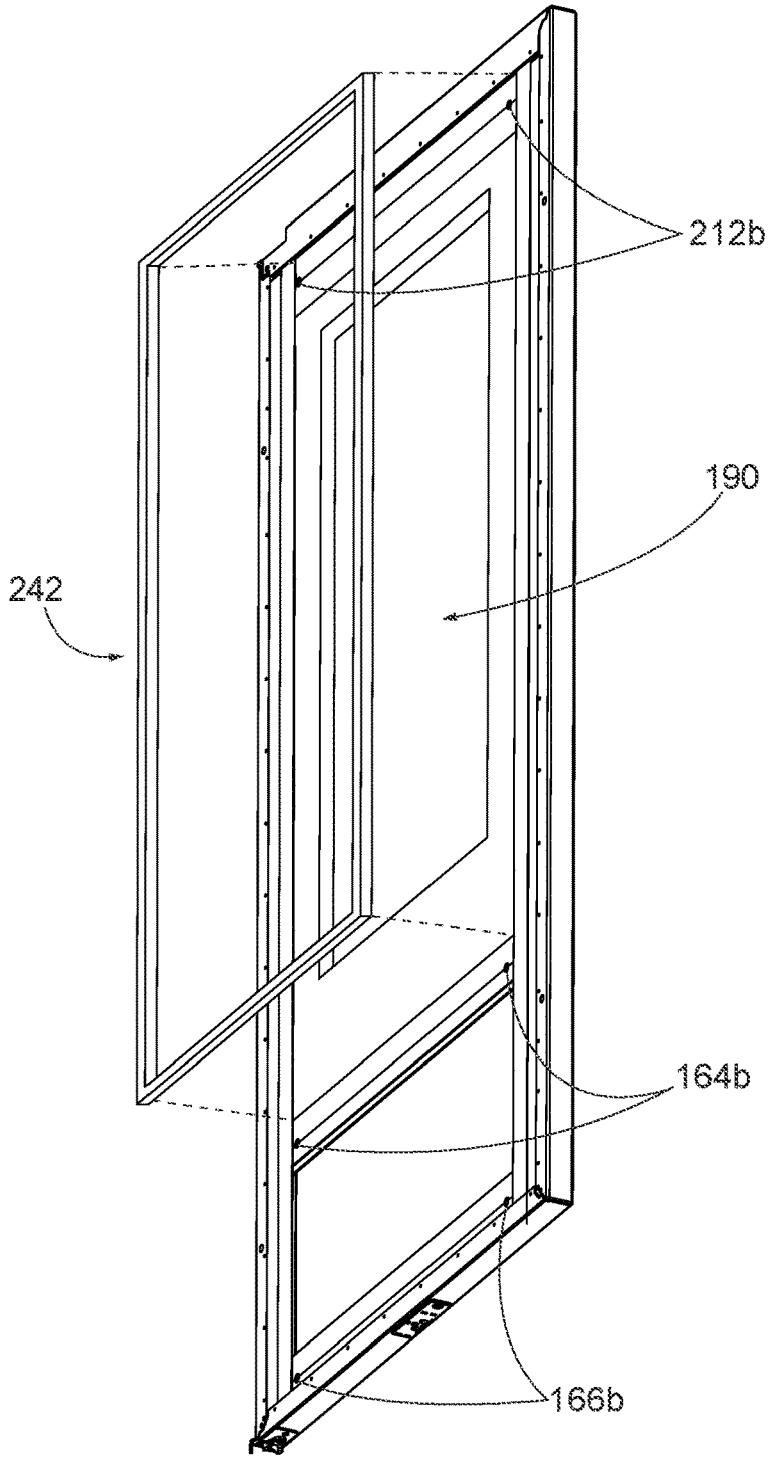
FIG. 12 is an exploded view of an example sealing gasket disposed adjacent an upper portion of the assembly shown in FIG. 11.

Referring to FIG. 12, a plurality of fasteners (not shown) is used to secure the frame assembly 140 and the upper frame assembly 210 together. In particular, fasteners, e.g., screws, can be inserted into the angled holes 164*b*, 166*b*, 212*b* in the upper beam 164, lower beam 166 and upper support rail 212, respectively, for securing the frame assembly 140 and the upper frame assembly 210 together. Thereafter, a tape 242 is placed around an outer periphery of the window 190. The tape 242 can be a foam insulation tape that provides additional thermal insulation. The tape 242 is used to fill a gap between the exterior perimeter of the window 192 and the adjacent beams 142A-B, upper beam 164, lower beam 166 and upper support rail 212, etc. Additional tape and/or insulation (not shown) can be placed over the screws to provide addition thermal insulation. It is also contemplated that additional insulation can be added, as needed, at other locations to improve the thermal insulation of the door 50. Optionally, as shown in FIG. 10B, a sealing tape 243 may be added along some or all joints or gaps between the panel 62 and the beams 142A-B, upper beam 164, lower beam 166 and upper support rail 212 to further inhibit or prevent heat transfer or cold air loss, etc. Although the upper frame assembly 210 is not shown in FIG. 10B, it is understood that the sealing tape 243 may be adhered thereto.

Liner Assembly 250

Figure 13:
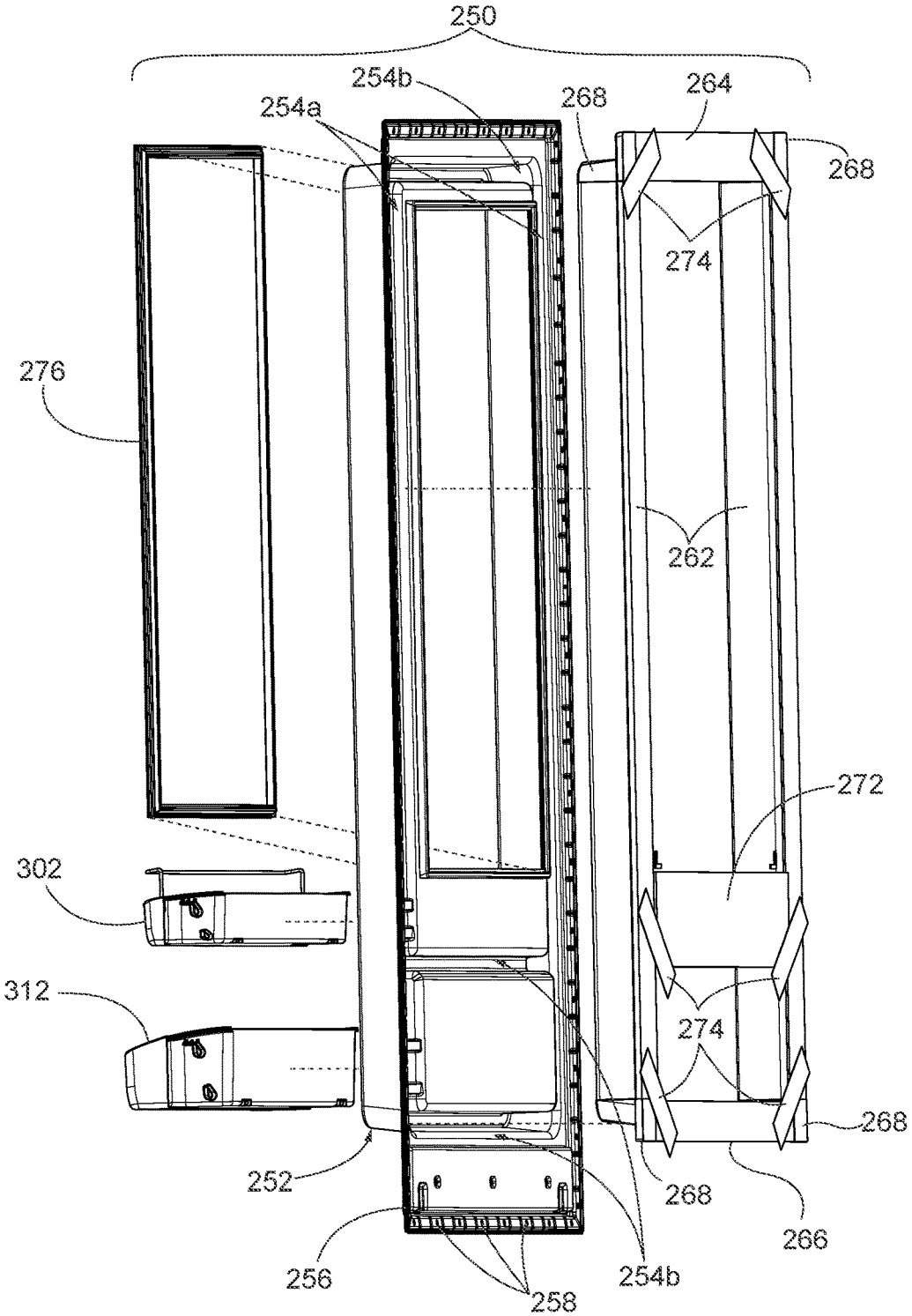
FIG. 13 is a rear exploded view of a door liner assembly shown in FIG. 5.

The door liner assembly 250 (FIG. 5) is attached to a back of the door 50. The liner assembly 250 closes the interior of the panel 62, while also providing a user-facing surface of the refrigerator door 50. Referring now to FIG. 13, the liner assembly 250 includes a door panel 252, side insulation dikes 262, a top insulation dike 264, a bottom insulation dike 266, corner insulation elements 268 and bins 302, 312.

The door panel 252 can be made of plastic or a similar material and be formed (e.g., by deep drawing or injecting molding) to define a contoured inner surface of the door 50 with various features, e.g., rails 253 (FIG. 5), as needed. The rails 253 can be dimensioned and configured to allow the bins 302, 312 and other similar components to be removably mounted to the inner surface of the door panel 252. A mounting flange 256 extends outwardly from an outer periphery of the door panel 252. A plurality of spaced-apart holes 258 are optionally formed in the flange 256 for receiving the plurality of fasteners 282 (FIG. 5), as described in detail below.

A rear surface of the door panel 252 can be contoured to define a two elongated vertical recesses 254*a* and a plurality of elongated horizontal recesses 254*b*. The vertical recesses 254*a* and the horizontal recesses 254*b* are dimensioned for receiving the side, top and bottom insulation dikes 262, 264, 266 and the corner insulation elements 268. The side, top and bottom insulation dikes 262, 264, 266 and the corner insulation elements 268 provide thermal insulation for the door panel 252 to help maintain the cabinet 16 within the desired temperature range. The side insulation dikes 262, the top and bottom insulation dikes 264, 266 and the corner insulation elements 268 can be made formed from an insulating material, such as solid, pre-formed expanded polystyrene (EPS), fiberglass, or could be made to receive liquid foam insulation that cures rigid.

The side insulation dikes 262 are dimensioned and contoured to be received into the vertical recesses 254*a* of the door panel 252. The top and bottom insulation dikes 264, 266 are dimensioned and contoured to be received into the vertical recesses 254*a* at the top and bottom of the door panel, respectively. The corner insulation elements 268 are disposed in the corners where the vertical recesses 254*a* and horizontal recesses 254*b* meet. It is also contemplated that the corner insulation elements 268 can be formed as part of the side insulating dikes 262 and/or the top and bottom insulation dikes 264, 266.

An insulation panel 272 is attached to a rear surface of the door panel 252 to cover the horizontal recess 254*b* in a central portion of the door panel 252. The insulation panel 272 can be formed from an insulating material, such as solid, pre-formed expanded polystyrene (EPS) or fiberglass. A plurality of pieces of tape 274 can be provided to hold the side insulation dikes, 262, the top and bottom insulation dikes 264, 266, the corner insulation elements 268 and the insulation panel 272 to the door panel 252 during the assembly process.

A window frame 276 can be placed in the door panel 252 to define a frame for the window 190 (FIG. 5) about its periphery on the interior of the door, e.g., a decorative trim. The frame 276 can be made of materials, such as plastic, rubber, etc. for providing a seal between the door panel 252 and the window 190 (FIG. 5). The window frame 276 can be a single monolithic element, but can be made of multiple elements.

Referring to FIG. 5, the door liner assembly 250 can be secured to the panel 62 in various manners. In one example, a plurality of fasteners 282 extend through the plurality of holes 258 in the door panel 252 into the plurality of spaced-apart holes 72 in the outer panel assembly 60 and to the plurality of spaced-apart holes 226 in the upper frame assembly 210 to secure the door panel 252 to the outer panel assembly 60 and the end cap 224. A gasket or door seal 284 is placed on the flange 256 of the door panel 252 for covering the plurality of fasteners 282 and providing a seal between the door 50 and the cabinet 16 of the refrigerator 10 when the door 50 is in the closed position (FIGS. 1 and 2). In another example, various clasps, clips, or the like could be used. In yet another example, adhesives or welding, or potentially liquid insulation that cures rigid, could be used.

Door Handle Assembly 290

Figure 14:
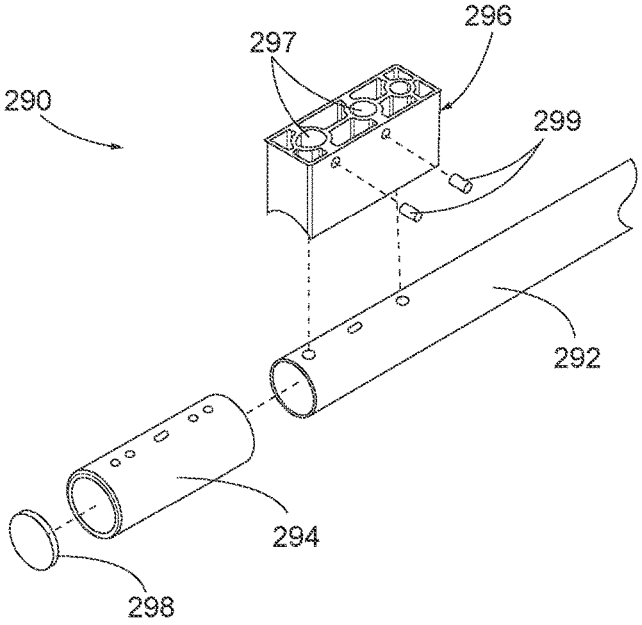
FIG. 14 is an exploded view of an example handle assembly shown in FIG. 1.
Figure 15:
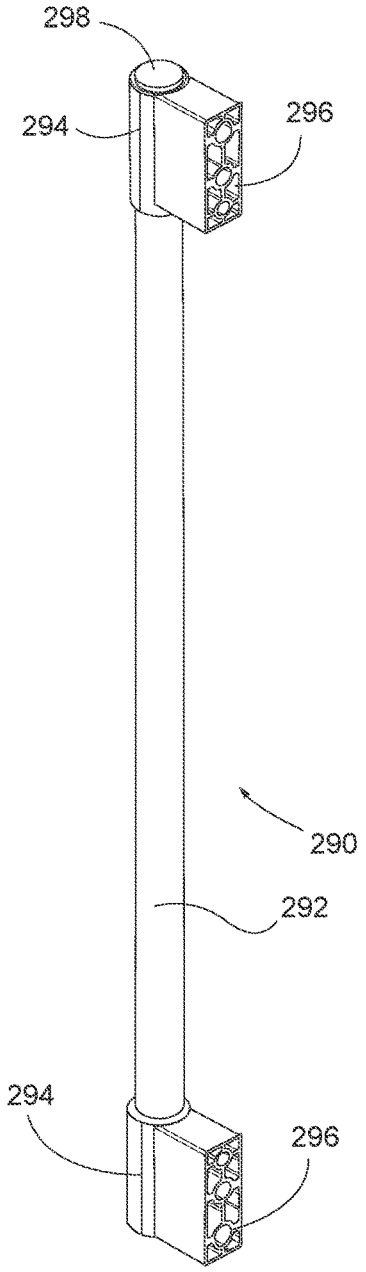
FIG. 15 is a perspective view of the handle assembly shown in FIG. 14.

Referring to FIGS. 1 and 15, the door 50 includes a handle assembly 290 for allowing a user to move the door 50 between an open position and a closed position relative to the cabinet 16. Referring to FIG. 14, the handle assembly 290 includes an elongated bar 292, a sleeve 294 and a mount 296. One sleeve 294 is dimensioned to be positioned over each end of the bar 292. The sleeve 294 can be made from a different material and/or have a different surface finish than the material and/or the finish of the bar 292 to provide an aesthetically pleasing appearance. In the embodiment shown, the bar 292 has a circular cross section between opposite ends of the bar 292. It is contemplated that the bar 292 can have other cross sectional shapes, e.g., square, oval, rectangular, etc. or have a cross section that varies along the length of the bar 292 between the ends of the bar 292.

A plug or cap 298 can be inserted into an end of the sleeve 294 and/or an end of the bar 292 to provide a smooth finish to the end of the bar 292. The sleeve 294 and the bar 292 can be secured to the mount 296 using attachment methods such as snap-fits, fasteners, etc. The mount 296 includes a plurality of holes 297 that are dimensioned and positioned to align with fasteners (not shown) that extend through the front 64 of the panel 62, as described in detail above. Set screws 299 can be used to secure the mount 296 to the screws extending through the panel 62. It is also contemplated that other attachment methods, such as snaps, bolts, etc. can be used to secure the mount 296 to the fasteners.

Shelves or Bins 278

Figure 4A:
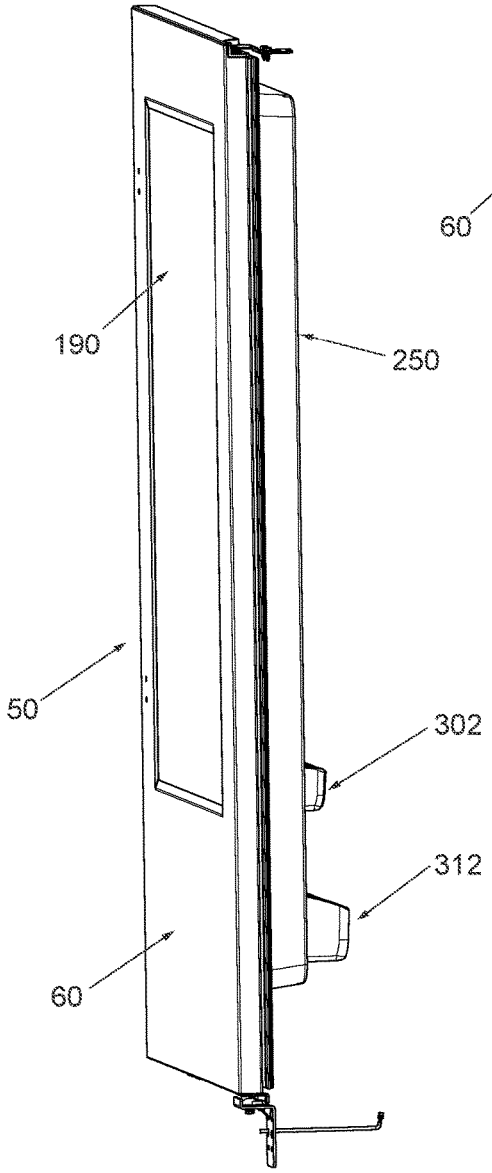
FIG. 4A is a front perspective view of the door shown in FIG. 3.
Figure 4B:
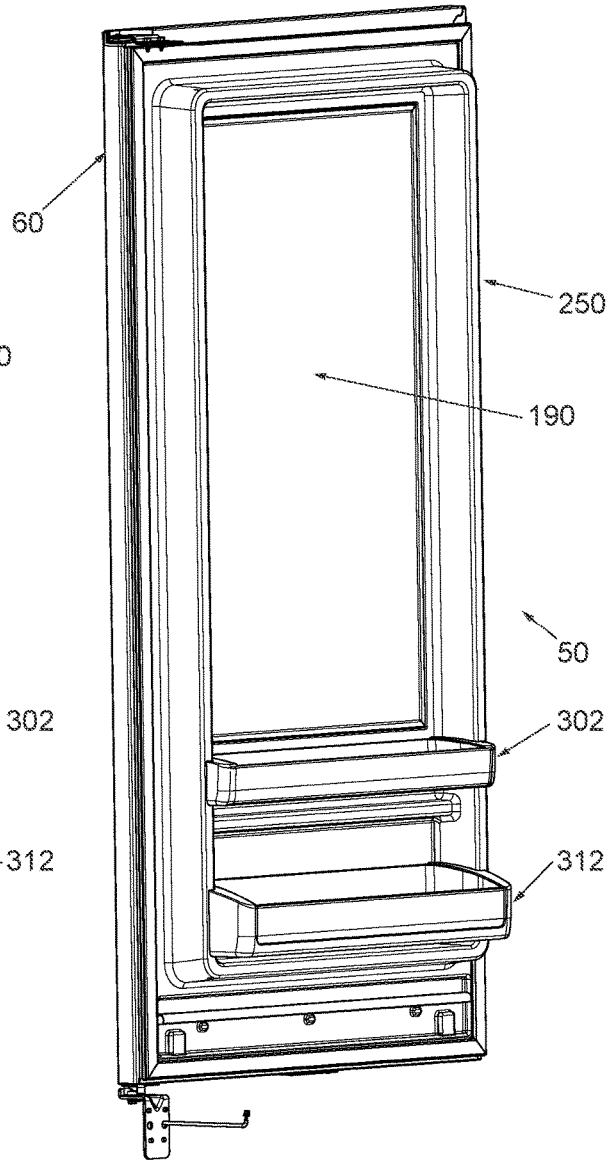
FIG. 4B is a rear perspective view of the door shown in FIG. 3.

Referring to FIG. 3, shelves or bins 278 are disposed on a lower portion of the inside of the door 50. In this manner, the user obtains increased storage space and flexibility on the interior of the refrigerator door despite the large window 190. Optionally, one or more door bins could likewise be placed at other locations on the door 50, such as at an upper portion or at a location between the upper and lower portions (e.g., at a middle location). The shelves or bins 278 are provided for storing food items of various shapes and sizes. The door 50 can be selectively configured to support various combinations of one or more shelves or bins 278. For example, the door 50 can be configured to support two smaller adjacent shelves disposed above one long shelf (for example, as shown in FIG. 3). It is also contemplated that the door 50 can support a single shallow bin 302 and a single deep bin 312 that extend a width of the door (for example, as shown in FIGS. 4B and 5). As discussed previously, the "blacked out" portion 192 of the window 190 can be configured to conceal or inhibit viewing the items stored on these shelves or bins 278. This provides a clean appearance to the front of the refrigerator door despite the various items that are stored on the door interior.

Figure 16:
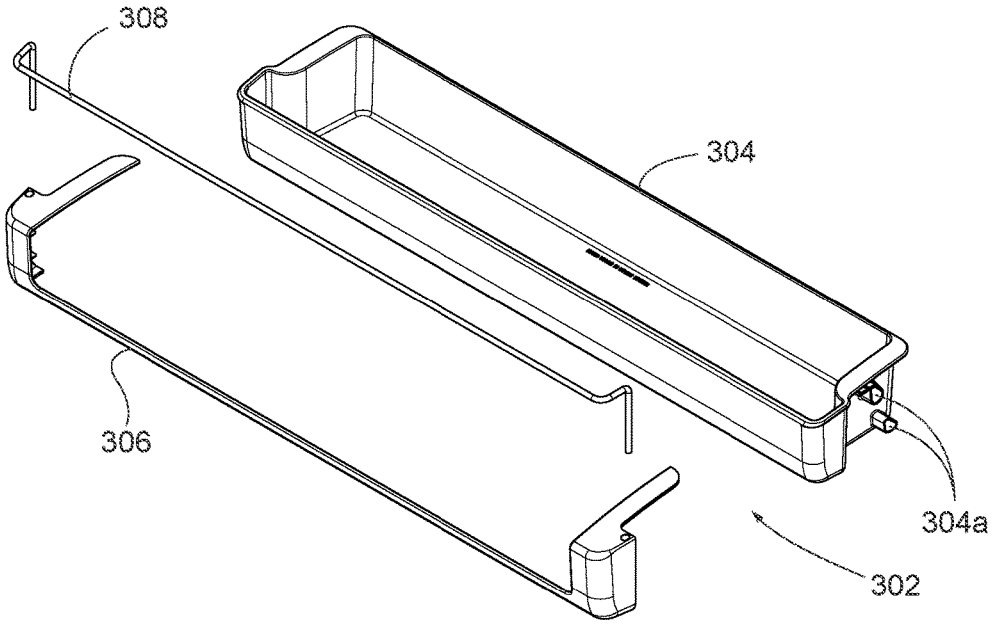
FIG. 16 is an exploded view of an example shallow bin assembly shown in FIG. 4B.

Referring to FIG. 16, the shallow bin 302 includes an elongated tub or holder 304, a trim piece 306 and a retaining bar 308. The elongated holder 304 includes protrusions 304*a* that are positioned and dimensioned on the sides of the holder 304 to mate with corresponding rails 253 (FIG. 5) formed in the door panel 252 for allowing the shallow bin 302 to be removably attached to the door panel 252. The retaining bar 308 is attachable to a front of the holder 304 for providing an aesthetically pleasing appearance. The retaining bar 308 is attachable to the trim piece 306 to provide additional support for large items that may be placed in the shallow bin 302. The retaining bar 308 can be a formed metal rod that attaches to the trim piece 306. It is also contemplated that the trim piece 306 or the holder 304 can be made to have a higher front wall (not shown) such that retaining bar 308 is not required. The trim piece 306 and the tub or holder 304 can be made from plastic, e.g., acrylonitrile butadiene styrene (ABS), or a similar material.

Figure 17:
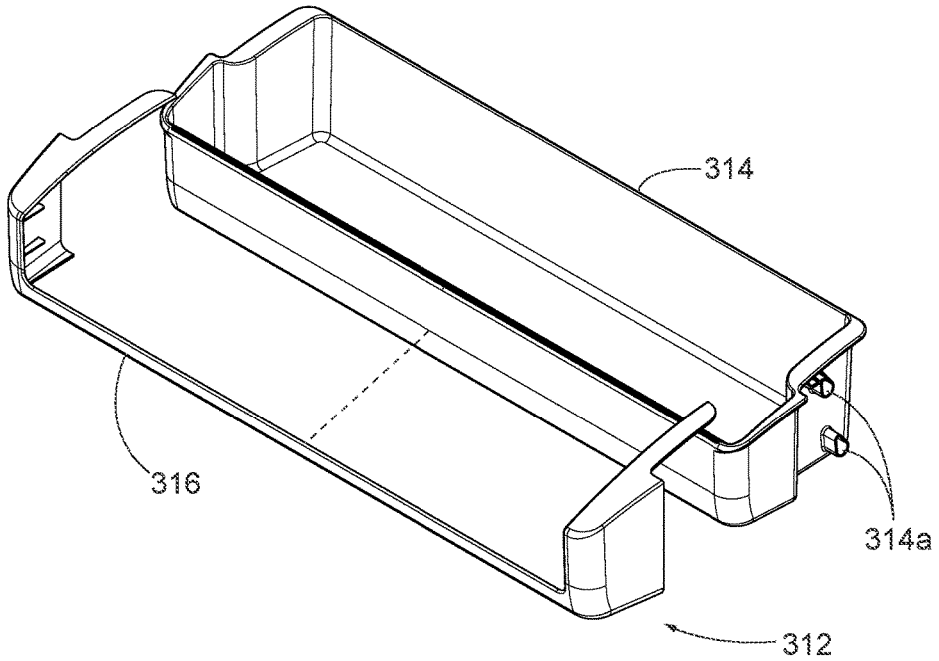
FIG. 17 is an exploded view of an example large bin assembly shown in FIG. 4B.

Referring to FIG. 17, the deep bin 312 is similar to the shallow bin 302 but includes an elongated tub or holder 314 that is deeper than the holder 304 of the shallow bin 302. The deep bin 312 is designed to hold larger items, e.g., gallon-sized containers. The deep bin 312 includes a trim piece 316 that provides an aesthetically pleasing front for the deep bin 312. Protrusions 314*a* extend from the sides of the holder 314 to mate with corresponding rails 253 (FIG. 5) formed in the door panel 252 for allowing the deep bin 312 to be removable attached to the door panel 252. The trim piece 316 and the tub or holder 314 can be made from plastic, e.g., acrylonitrile butadiene styrene (ABS), or a similar material. It is contemplated that either of the bins 302, 312 could include various other features to store specialized items, such as a can rack or wine bottle rack. For example, the bin(s) could include depressions or other features that especially correspond to the shape of aluminum soda cans or wine bottles that inhibit tilting or spilling of these items when the door is moved. Such features could also be used to provide better presentation of the items within the refrigerator (i.e., present the wine bottles through the window in a pleasing manner), and may enable the items to be visible partially or completely above the "blacked out" area of the window 190.

Controller 30

Figure 18:
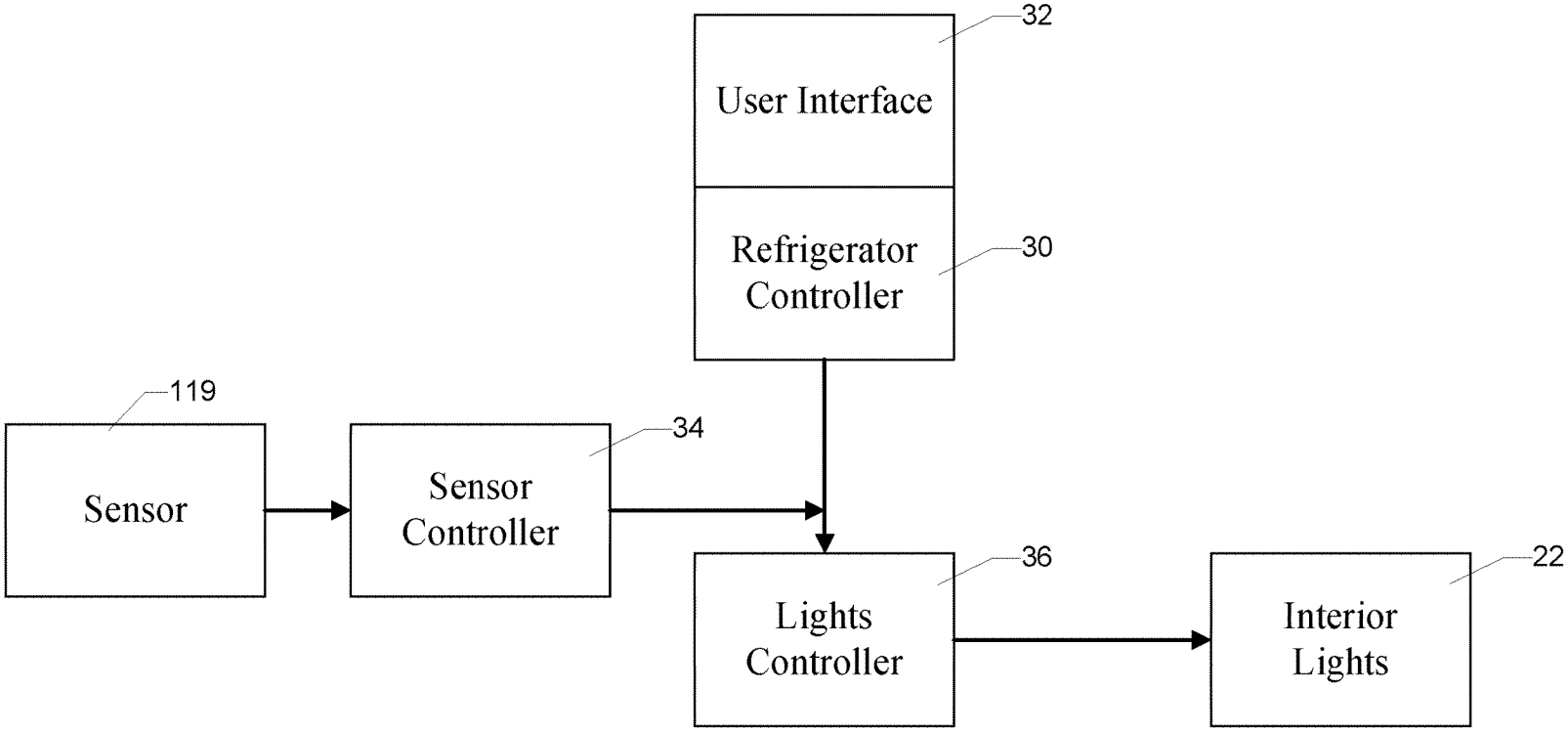
FIGS. 18-19 are a schematic views showing different embodiments of connections between several electronic components of the refrigerator shown in FIG. 1.
Figure 19:
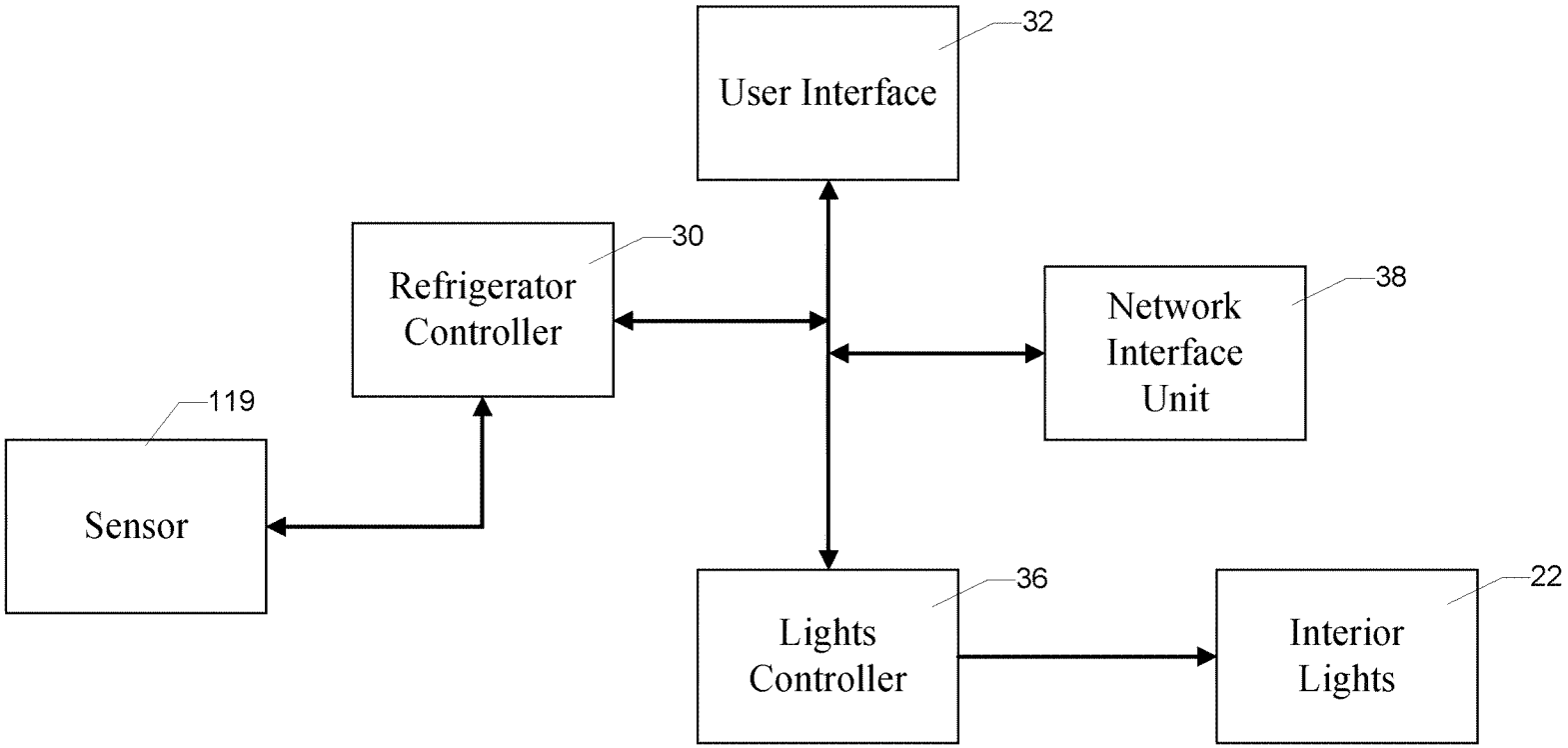

Referring to FIG. 18, the sensor 119 or sensor board 118 can provide a signal to a controller 30, 34, 36 of the refrigerator. In one embodiment, the controller is a main system controller 30 provided for controlling the operation of the refrigerator 10 (FIG. 1). The controller 30 can be mounted within the cabinet 16 (FIG. 1) at a location that is convenient and easily accessed by service technicians. The controller 30 can be a computer, a simple circuit board, or other control devices commonly known to those skilled in the art. Preferably the controller is digital, but may be partially or completely analog. In another embodiment, the controller can be a dedicated sensor controller 34, which may operate separately from the main system controller 30. Optionally, a dedicated lights controller 36 can be used that directly activates or deactivates the interior lighting within the refrigerator cabinet.

The main system controller 30 communicates with a user interface 32 for providing information to a user, e.g., temperature, status, etc. and allowing the user to input commands to the controller to control the operation of the refrigerator 10, as described in detail below. The user interface 32 can be a simple LED display, buttons, knobs, a monitor and keypad/keyboard, a touch screen, etc. or combinations of the foregoing.

As described above, the sensor controller 34 can be attachable to the sensor 119 or sensor board 118 and be mounted in the cabinet 16, and may include a power sub-assembly. It is also contemplated that the sensor controller 34 can be part of the controller 30 such that a separate power assembly is not required. As such, the controller 30 may interface directly with the sensor 119 or sensor board 118.

The controller 30, 34, 36 is also configured to selectively energize the interior lights 22 of the refrigerator 10, as described in detail below. Preferably, the main controller 30 or sensor controller 34 operate the lights via a dedicated lights controller 36, although it is contemplated that the controller 30, 34 could directly operate the lights without an intermediate component. The interior lights 22 can be conventional light bulbs or light emitting diodes (LED) that are positioned at predetermined locations within the cabinet 16 to properly illuminate the cabinet 16. It is contemplated that the interior lights 22 can have a single illumination level, or optionally one illumination level when the door 50 is closed and a second illumination level when the door 50 is open. It also contemplated that the illumination level of the interior lights can be selected by the user via the user interface 32. Lastly, it is contemplated that the controller 30 or an attached component such as a network interface unit 38 can have network connectivity features, which may include any known or discovered wired or wireless network connectivity protocols (local area networks or wide area networks, including the internet), to provide remote control, status, or service features. Preferably, the wireless network connectivity protocols include WiFi, Bluetooth, NFC, ZigBee, etc. For example, the controller 30, 34 can utilize network connectivity to allow a user to remotely monitor and control the refrigerator temperature or interior lighting (modes of operation, light intensity, light color, etc.), to obtain remote status indicators of the refrigerator and interior lighting, to alter the modes of operation or sensitivity of the sensor, or light intensity or light color, or display mode (e.g., spotlight, image, countdown timer, time-of-day/clock/date) of the sensor illumination that highlights the target area, or even to provide service information.

Operation

The door 50 is designed to allow a user to view the contents of the cabinet 16 without opening the door 50 by selectively illuminating the interior of the cabinet to backlight the window 190. As described above, the door 50 includes a sensor assembly 114 that detects that presence of a user at the predetermined location 20. It is contemplated that the sensor assembly 114 can be configured to detect when a foot of the user is placed at the location 20. It is contemplated that the location 20 can be between about 3 inches and about 5 inches in front of the refrigerator 10. It is also contemplated that the location 20 can be about 3.5 inches in front of the refrigerator 10.

The interior lights 22 in the cabinet 16 of the refrigerator 10 will remain energized for a predetermined period of time after the sensor assembly 114 detects a user's presence at the location 20. The predetermined period of time can be about 30 seconds, within the range of 30-120 seconds, or any other user-selected period of time. It is also contemplated that the controller 30, 34 may be programmed to play an audible sound when the sensor assembly 114 detects the presence of the user at the location 20.

The controller 30, 34 can be configured to allow the user to disable the automatic illumination of the interior lights 22 and place the controller 30, 34 in one or more "special modes." The following description includes example steps that can be taken to place the controller 30, 34 in a "special mode." It is contemplated that the various described methods or protocols of activating or deactivating any particular mode may be interchanged or combined, and are not intended to be limited to the specific modes as described with the examples herein. It is further contemplated that the controller 30, 34 can be programmed to recognize other steps to initiate the foregoing special modes of operation. Where the sensor assembly 114 is configured to detect a user's foot, the various activation and deactivation protocols for various operating modes can detect various numbers or combinations of actions, such as a user holding a foot under the sensor for certain period of time, swiping the foot past the sensor, or multiple successive foot swipes past the sensor. It is further contemplated that the user may select or change any of the foregoing special modes via interactions with the sensor, the user interface, or even via remote network connectivity features.

The controller 30, 34 can be programmed to allow the user to enable/disable the automatic illumination of the interior lights 22, and enable/disable a "special mode," using the sensor assembly 114. In one example protocol to disable the automatic illumination function, the user's foot must remain in the location 20 for about seven seconds. The user must then move from the location 20 and then return and remain at the location 20 for about three seconds. To enable the auto light function of the controller 30, 34, the user must repeat the foregoing steps. Alternatively, it is contemplated that enabling/disabling the automatic illumination of the interior lights 22, and enabling/disabling a "special mode," can be performed via a user-interface of the refrigerator, or even via a network connectivity feature.

One special mode can be a "Sabbath Mode" wherein the controller 30, 34 is programmed not to illuminate the cabinet 16 when the sensor assembly 114 detects the presence of the user at the location 20. The controller 30, 34 will remain in the Sabbath Mode until the user selects a different mode of operation.

Another special mode of the controller 30, 34 allows a user to illuminate the cabinet 16 for an extended period of time, for example, 30 minutes, up to 120 minutes, or continuously until deactivated. This can be useful as a demonstration mode. In one example protocol to enable the forgoing special mode, the user must remain in the location 20 for a predetermined period of time (for example, about seven seconds or about ten seconds) or until the interior lights 22 blink once. The user must quickly move into and out of the location 20, i.e., swipe past the location 20 a predetermined number of times (for example, two or three times). Thereafter, the interior lights 22 of the refrigerator 10 will blink once and remain energized for the extended period of time.

Similarly, it is contemplated that a special mode of the controller 30, 34 can allow a user to illuminate the cabinet 16 for an extended period of time at a reduced illumination level to provide a "night light" around the refrigerator. Such a "night light" feature could be configured to operate manually or automatically via the controller 30, 34, based upon a timer (e.g., at a predetermined daily time when it is dark) or made to operate in response to another sensor (not shown) that detects predetermined level(s) of ambient light around the refrigerator (e.g., the light illuminates when it is dark, and deactivates when it is bright), or combinations of timers and ambient light. The user could selectively adjust and program the light intensity and operation modes of the "night light" feature.

In another protocol to disable the foregoing special mode the user must move into and out of the location 20 a predetermined number of times (for example, three times) or until the interior lights 22 blink once. The user must remain in the location 20 for a predetermined time (for example, about ten seconds). Thereafter, the interior lights 22 will blink indicating that the controller 30 is returning to its normal auto light function.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigeration appliance comprising:

a cabinet defining a storage compartment; and a door pivotably coupled to the cabinet and movable between a closed position for closing the storage compartment and an open position for allowing access to the storage compartment, the door including:

an inner surface;

an outer surface;

an opening extending between the inner surface and the outer surface;

a window covering the opening, the window including a lower portion that is non-transparent;

a storage bin on a lower portion of the door, wherein the lower portion of the window obstructs viewing of the storage bin through the window when the door is in the closed position;

a sensor for detecting a presence of an object at a predetermined location proximate the door, the sensor operable to provide a signal to a controller indicative of the presence of the object at the predetermined location; and a light for illuminating a position of the predetermined location on a floor proximate the door.

2. The refrigeration appliance of claim 1, further comprising an interior light in the cabinet, wherein the window is tinted to hinder viewing through the window when the interior light is not energized.

3. The refrigeration appliance of claim 1, wherein the storage bin is removable from the door.

4. The refrigeration appliance of claim 1, further comprising:

a frame assembly disposed between the inner surface and the outer surface of the door, the frame assembly comprising:

a pair of vertical frame members each dimensioned to receive a preformed insulating element, and a lower support assembly attached to a lower portion of each of the pair of vertical frame members, the lower support assembly including a first horizontal frame member having distal ends attachable to each of the pair of vertical frame members wherein the first horizontal frame member is dimensioned to receive a preformed insulating element, and an upper frame member having distal ends attachable to an upper end of the pair of vertical frame members, the upper frame member dimensioned to receive a preformed insulating element.

5. The refrigeration appliance of claim 4, wherein the lower support assembly further comprises:

a second horizontal frame member spaced from the first horizontal frame member, the second horizontal frame member having distal ends attachable to each of the pair of vertical frame members and dimensioned to receive a preformed insulating element, and an insulation element extending between the first horizontal frame member and the second horizontal frame member.

6. The refrigeration appliance of claim 4, wherein at least one of the pair of vertical frame members, the first horizontal frame member and the upper frame member is an extruded plastic rail.

7. The refrigeration appliance of claim 6, wherein the extruded plastic rail includes an elongated inner cavity.

8. The refrigeration appliance of claim 4, wherein at least one of the pair of vertical frame members includes an elongated tab extending along one side and at least one the distal ends of the first horizontal frame member and the upper frame member includes a slot dimensioned to receive a corresponding elongated tab of the at least one of the pair of vertical frame members.

9. The refrigeration appliance of claim 1, wherein the sensor assembly is attached to a bottom surface of the door.

10. The refrigeration appliance of claim 1, wherein the sensor is an infrared sensor.

11. The refrigeration appliance of claim 1, wherein the light is configured to display at least one image on the floor and the image is at least one of a symbol, a word, a letter, a number, a picture, a time-of-day/clock/date and a countdown timer.

12. A door for a refrigeration appliance, the door pivotably coupled to a cabinet of the refrigeration appliance and movable between a closed position for closing a storage compartment of the cabinet and an open position for allowing access to the storage compartment, the door comprising:

an inner surface;

an outer surface;

an opening extending between the inner surface and the outer surface;

a window covering the opening;

a frame assembly disposed between the inner surface and the outer surface, the frame assembly comprising:

a pair of vertical frame members each receiving a preformed insulating element, and a lower support assembly attached to lower portion of each of the pair of vertical frame members, the lower support assembly including a first horizontal frame member having distal ends attachable to each of the pair of vertical frame members wherein the first horizontal frame member receives a preformed insulating element, and an upper frame member having distal ends attachable to an upper end of the pair of vertical frame members, the upper frame member receiving a preformed insulating element.

13. The door of claim 12, wherein the lower support assembly further comprises:

a second horizontal frame member spaced from the first horizontal frame member, the second horizontal frame member having distal ends attachable to at least one of the pair of vertical frame members and dimensioned to receive a preformed insulating element, and an insulation element extending between the first horizontal frame member and the second horizontal frame member.

14. The door of claim 12, wherein at least one of the pair of vertical frame members, the first horizontal frame member and the upper frame member is an extruded plastic rail.

15. The door of claim 14, wherein the extruded plastic rail includes an elongated inner cavity.

16. The door of claim 12, wherein at least one of the pair of vertical frame members includes an elongated tab extending along one side and at least one of the distal ends of the first horizontal frame member, and the upper frame member includes a slot dimensioned to receive a corresponding elongated tab of the at least one of the pair of vertical frame members.

17. The door of claim 12, further comprising:

a storage bin on a lower portion of the door, wherein the window includes a lower portion that is non-transparent for obstructing viewing of the storage bin when the door is in the closed position.

18. The door of claim 17, wherein the storage bin is removable from the door.

19. The door of claim 12, further comprising an interior light in the cabinet, wherein the window is tinted to hinder viewing through the window when the interior light is not energized.

20. The door of claim 12, further comprising a sensor including:

a sensor for detecting a presence of an object at a predetermined location proximate the door, the sensor operable to provide a signal to a controller indicative of the presence of the object at the predetermined location; and a light for illuminating a position of the predetermined location.

21. A door for a refrigeration appliance, the door pivotably coupled to a cabinet of the refrigeration appliance and movable between a closed position for closing a storage compartment of the cabinet and an open position for allowing access to the storage compartment, the door comprising:

an inner surface;

an outer surface;

an opening extending between the inner surface and the outer surface;

a window covering the opening;

a frame assembly disposed between the inner surface and the outer surface, the frame assembly comprising:

a pair of vertical frame members each receiving a preformed insulating element, and a lower support assembly attached to lower portion of each of the pair of vertical frame members, the lower support assembly including a first horizontal frame member having distal ends attachable to each of the pair of vertical frame members, the first horizontal frame member receiving a preformed insulating element, an upper frame member having distal ends attachable to an upper end of the pair of vertical frame members, the upper frame member receiving a preformed insulating element; and a storage bin on a lower portion of the door wherein the lower portion of the window obstructs viewing of the storage bin when the door is in the closed position.

22. The door of claim 21, further comprising a sensor assembly including:

a sensor for detecting a presence of an object at a predetermined location proximate the door, the sensor operable to provide a signal to a controller indicative of the presence of the object at the predetermined location; and a light for illuminating a position of the predetermined location.

23. The door of claim 21, further comprising an interior light in the cabinet, wherein the window is tinted to hinder viewing the storage compartment through the window when the interior light is not energized, and wherein energizing the interior light permits the storage compartment to be visible through the window.

24. The door of claim 21, wherein the storage bin is removable from the door.

* * * * *